US007753773B2

(12) United States Patent
Baerlocher et al.

(10) Patent No.: US 7,753,773 B2
(45) Date of Patent: Jul. 13, 2010

(54) GAMING DEVICE HAVING PHYSICAL CONCENTRIC SYMBOL GENERATORS WHICH ARE OPERABLE TO PROVIDE A PLURALITY OF DIFFERENT GAMES TO A PLAYER

(75) Inventors: Anthony J. Baerlocher, Reno, NV (US); Joseph E. Kaminkow, Reno, NV (US); James A. Vasquez, Carson City, NV (US)

(73) Assignee: IGT, Reno, NV (US)

( * ) Notice: Subject to any disclaimer, the term of this patent is extended or adjusted under 35 U.S.C. 154(b) by 1268 days.

(21) Appl. No.: 11/212,354

(22) Filed: Aug. 26, 2005

(65) Prior Publication Data

US 2007/0060246 A1 Mar. 15, 2007

(51) Int. Cl.
*A63B 71/00* (2006.01)

(52) U.S. Cl. ..... 463/20; 463/16; 273/143 HA; 273/143 R

(58) Field of Classification Search ..... 463/20; 273/143 R

See application file for complete search history.

(56) References Cited

U.S. PATENT DOCUMENTS

| | | | |
|---|---|---|---|
| 1,978,395 | A | 10/1934 | Groetchen |
| D164,309 | S | 8/1951 | McManus |
| D208,030 | S | 7/1967 | Weinard |
| 3,420,525 | A | 1/1969 | Waders |
| 3,642,287 | A | 2/1972 | Lally et al. |
| 3,667,757 | A | 6/1972 | Holmberg |
| 3,735,987 | A | 5/1973 | Ohki |
| D260,769 | S | 9/1981 | Thomas |
| 4,326,351 | A | 4/1982 | Heywood et al. |
| 4,335,809 | A | 6/1982 | Wain |
| 4,410,178 | A | 10/1983 | Partridge |
| 4,448,419 | A | 5/1984 | Telnaes |
| 4,517,558 | A | 5/1985 | Davids |
| 4,572,509 | A | 2/1986 | Sitrick |
| 4,652,998 | A | 3/1987 | Koza et al. |
| 4,695,053 | A | 9/1987 | Vazquez, Jr. et al. |
| 4,756,531 | A | 7/1988 | DiRe et al. |
| 4,790,537 | A | 12/1988 | Smyth et al. |
| 4,826,169 | A | 5/1989 | Bessho et al. |

(Continued)

FOREIGN PATENT DOCUMENTS

| | | |
|---|---|---|
| AU | 74936/87 | 6/1987 |

(Continued)

OTHER PUBLICATIONS

Austin Powers in Goldmember advertisement, written by IGT, published in 2003.

(Continued)

*Primary Examiner*—Peter DungBa Vo
*Assistant Examiner*—Omkar Deodhar
(74) *Attorney, Agent, or Firm*—K&L Gates LLP

(57) ABSTRACT

A gaming system with a central server or controller operable to communicate a plurality of different game programs to one, more or each of the gaming devices, wherein each gaming device executes the communicated game program by utilizing one, more or each of the concentric reels. Each game program represents a different setting, configuration or type game which may be played on one, more or each of the gaming devices in the gaming system.

52 Claims, 13 Drawing Sheets

U.S. PATENT DOCUMENTS

| | | | | |
|---|---|---|---|---|
| 4,836,553 | A | | 6/1989 | Suttle et al. |
| 4,842,278 | A | | 6/1989 | Markowicz |
| 4,856,787 | A | * | 8/1989 | Itkis ..... 273/237 |
| 4,861,041 | A | | 8/1989 | Jones et al. |
| 4,866,515 | A | | 9/1989 | Tagawa et al. |
| 4,871,171 | A | | 10/1989 | Rivero |
| 4,978,129 | A | | 12/1990 | Komeda et al. |
| 4,991,848 | A | | 2/1991 | Greenwood et al. |
| 5,046,735 | A | | 9/1991 | Hamano et al. |
| 5,078,405 | A | | 1/1992 | Jones et al. |
| 5,098,107 | A | | 3/1992 | Boylan et al. |
| 5,152,529 | A | * | 10/1992 | Okada ..... 463/20 |
| 5,169,147 | A | | 12/1992 | Hamano et al. |
| 5,179,517 | A | | 1/1993 | Sarbin et al. |
| 5,209,479 | A | | 5/1993 | Nagao et al. |
| 5,259,616 | A | | 11/1993 | Bergmann |
| 5,276,312 | A | | 1/1994 | McCarthy |
| 5,305,195 | A | | 4/1994 | Murphy |
| 5,308,065 | A | | 5/1994 | Bridgeman et al. |
| 5,332,228 | A | | 7/1994 | Schultz |
| 5,342,049 | A | | 8/1994 | Wichinsky et al. |
| 5,344,144 | A | | 9/1994 | Canon |
| 5,364,100 | A | | 11/1994 | Ludlow et al. |
| 5,377,993 | A | | 1/1995 | Josephs |
| 5,393,057 | A | | 2/1995 | Marnell, II |
| 5,393,061 | A | | 2/1995 | Manship et al. |
| 5,395,111 | A | | 3/1995 | Inoue |
| 5,404,567 | A | | 4/1995 | DePietro et al. |
| 5,423,539 | A | | 6/1995 | Nagao |
| 5,429,361 | A | | 7/1995 | Raven et al. |
| 5,430,791 | A | | 7/1995 | Feit et al. |
| 5,431,408 | A | | 7/1995 | Adams |
| 5,449,173 | A | | 9/1995 | Thomas et al. |
| 5,456,465 | A | | 10/1995 | Durham |
| 5,465,082 | A | | 11/1995 | Chaco |
| 5,476,259 | A | | 12/1995 | Weingardt |
| 5,511,781 | A | | 4/1996 | Wood et al. |
| 5,524,888 | A | | 6/1996 | Heidel |
| 5,530,232 | A | | 6/1996 | Taylor |
| 5,530,469 | A | | 6/1996 | Garfinkle |
| 5,553,864 | A | | 9/1996 | Sitrick |
| 5,559,313 | A | | 9/1996 | Claus et al. |
| 5,560,603 | A | | 10/1996 | Seelig et al. |
| 5,564,700 | A | | 10/1996 | Celona |
| 5,566,337 | A | | 10/1996 | Szmanski et al. |
| 5,578,808 | A | | 11/1996 | Taylor |
| 5,584,764 | A | | 12/1996 | Inoue |
| 5,586,257 | A | | 12/1996 | Perlman |
| 5,586,937 | A | | 12/1996 | Menashe |
| 5,609,524 | A | | 3/1997 | Inoue |
| 5,611,535 | A | | 3/1997 | Tiberio |
| 5,617,331 | A | | 4/1997 | Wakai et al. |
| 5,626,341 | A | | 5/1997 | Jones et al. |
| 5,630,757 | A | | 5/1997 | Gagin et al. |
| 5,640,192 | A | | 6/1997 | Garfinkle |
| 5,647,798 | A | | 7/1997 | Falciglia |
| 5,649,118 | A | | 7/1997 | Carlisle et al. |
| 5,655,961 | A | | 8/1997 | Acres et al. |
| 5,664,998 | A | | 9/1997 | Seelig et al. |
| 5,702,304 | A | | 12/1997 | Acres et al. |
| 5,722,891 | A | | 3/1998 | Inoue |
| 5,741,183 | A | | 4/1998 | Acres et al. |
| 5,752,881 | A | | 5/1998 | Inoue |
| 5,752,882 | A | | 5/1998 | Acres et al. |
| 5,755,621 | A | | 5/1998 | Marks et al. |
| 5,759,102 | A | | 6/1998 | Pease et al. |
| 5,762,552 | A | | 6/1998 | Vuong et al. |
| 5,766,076 | A | | 6/1998 | Pease et al. |
| 5,769,716 | A | | 6/1998 | Saffari et al. |
| 5,772,506 | A | | 6/1998 | Marks et al. |
| 5,775,692 | A | | 7/1998 | Watts et al. |
| 5,779,545 | A | | 7/1998 | Berg et al. |
| 5,788,573 | A | | 8/1998 | Baerlocher et al. |
| 5,800,268 | A | | 9/1998 | Molnick |
| 5,806,855 | A | | 9/1998 | Cherry |
| 5,816,915 | A | | 10/1998 | Kadlic |
| 5,820,459 | A | | 10/1998 | Acres et al. |
| 5,823,534 | A | | 10/1998 | Banyai |
| 5,823,873 | A | | 10/1998 | Moody |
| 5,823,874 | A | | 10/1998 | Adams |
| D400,597 | S | | 11/1998 | Hedrick et al. |
| 5,833,537 | A | | 11/1998 | Barrie |
| 5,833,538 | A | | 11/1998 | Weiss |
| 5,833,540 | A | | 11/1998 | Miodunski et al. |
| 5,836,817 | A | | 11/1998 | Acres et al. |
| 5,845,283 | A | | 12/1998 | Williams et al. |
| 5,848,932 | A | | 12/1998 | Adams |
| 5,851,011 | A | | 12/1998 | Lott |
| 5,851,148 | A | | 12/1998 | Brune et al. |
| 5,851,149 | A | | 12/1998 | Xidos et al. |
| D404,084 | S | | 1/1999 | Hedrick et al. |
| 5,855,515 | A | | 1/1999 | Pease et al. |
| 5,863,249 | A | | 1/1999 | Inoue |
| 5,868,618 | A | | 2/1999 | Netley et al. |
| 5,868,619 | A | | 2/1999 | Wood et al. |
| D406,615 | S | | 3/1999 | Griswold et al. |
| 5,876,284 | A | | 3/1999 | Acres et al. |
| 5,882,259 | A | | 3/1999 | Holmes, Jr. et al. |
| 5,882,261 | A | | 3/1999 | Adams |
| 5,885,158 | A | | 3/1999 | Torango et al. |
| 5,890,962 | A | | 4/1999 | Takemoto |
| 5,903,732 | A | | 5/1999 | Reed et al. |
| 5,905,248 | A | | 5/1999 | Russell et al. |
| 5,913,164 | A | | 6/1999 | Pawa et al. |
| 5,917,725 | A | | 6/1999 | Thacher et al. |
| 5,918,039 | A | | 6/1999 | Buswell et al. |
| 5,919,088 | A | | 7/1999 | Weiss |
| 5,934,672 | A | | 8/1999 | Sines et al. |
| 5,935,002 | A | | 8/1999 | Falciglia |
| 5,941,773 | A | | 8/1999 | Harlick |
| 5,944,315 | A | | 8/1999 | Mostashari |
| 5,947,820 | A | | 9/1999 | Morro et al. |
| 5,947,822 | A | | 9/1999 | Weiss |
| 5,951,011 | A | | 9/1999 | Potter et al. |
| 5,951,653 | A | | 9/1999 | Hill et al. |
| 5,958,028 | A | | 9/1999 | Bean et al. |
| 5,971,271 | A | | 10/1999 | Wynn et al. |
| 5,971,849 | A | | 10/1999 | Falciglia |
| 5,974,409 | A | | 10/1999 | Sanu et al. |
| 5,980,093 | A | | 11/1999 | Jones et al. |
| 5,980,384 | A | | 11/1999 | Barrie |
| 5,983,190 | A | | 11/1999 | Trower, II et al. |
| 5,984,781 | A | | 11/1999 | Sunaga |
| 5,984,782 | A | | 11/1999 | Inoue |
| 5,991,760 | A | | 11/1999 | Gauvin et al. |
| 5,991,790 | A | | 11/1999 | Shah et al. |
| 5,996,068 | A | | 11/1999 | Dwyer, III et al. |
| 5,997,401 | A | | 12/1999 | Crawford |
| 5,999,808 | A | | 12/1999 | LaDue |
| 6,001,016 | A | | 12/1999 | Walker et al. |
| 6,003,066 | A | | 12/1999 | Ryan et al. |
| 6,003,094 | A | | 12/1999 | Dean |
| 6,003,123 | A | | 12/1999 | Carter et al. |
| 6,003,867 | A | | 12/1999 | Rodesch et al. |
| 6,027,115 | A | | 2/2000 | Griswold et al. |
| 6,033,307 | A | | 3/2000 | Vancura |
| 6,056,642 | A | | 5/2000 | Bennett |
| 6,059,289 | A | | 5/2000 | Vancura |
| 6,059,658 | A | | 5/2000 | Mangano et al. |
| 6,062,980 | A | | 5/2000 | Luciano |
| 6,068,552 | A | | 5/2000 | Walker et al. |
| 6,085,247 | A | | 7/2000 | Parsons, Jr. et al. |
| 6,086,066 | A | | 7/2000 | Takeuchi et al. |
| 6,089,976 | A | | 7/2000 | Schneider et al. |

6,089,977 A 7/2000 Bennett
6,089,978 A 7/2000 Adams
6,089,982 A 7/2000 Holch et al.
6,095,921 A 8/2000 Walker et al.
6,102,798 A 8/2000 Bennett
6,110,041 A 8/2000 Walker et al.
6,117,013 A 9/2000 Eiba
6,120,031 A 9/2000 Adams
6,120,378 A 9/2000 Moody
6,126,541 A 10/2000 Fuchs
6,126,542 A 10/2000 Fier
6,135,884 A 10/2000 Hedrick et al.
6,135,887 A 10/2000 Pease et al.
6,141,737 A 10/2000 Krantz et al.
6,142,873 A 11/2000 Weiss et al.
6,142,874 A 11/2000 Kodachi et al.
6,142,875 A 11/2000 Kodachi et al.
6,149,521 A 11/2000 Sandusky
6,162,121 A 12/2000 Morro et al.
6,162,122 A 12/2000 Acres et al.
6,165,070 A 12/2000 Nolte et al.
6,168,520 B1 1/2001 Baerlocher et al.
6,174,234 B1 1/2001 Seibert et al.
6,174,235 B1 1/2001 Walker et al.
6,190,254 B1 2/2001 Bennett
6,210,279 B1 4/2001 Dickinson
6,213,876 B1 4/2001 Moore, Jr.
6,217,448 B1 4/2001 Olsen
6,220,959 B1 4/2001 Holmes, Jr. et al.
6,224,483 B1 5/2001 Mayeroff
6,227,971 B1 5/2001 Weiss
6,238,287 B1 5/2001 Komori et al.
6,241,608 B1 6/2001 Torango
6,251,013 B1 6/2001 Bennett
6,254,483 B1 7/2001 Acres
6,261,177 B1 7/2001 Bennett
6,270,411 B1 8/2001 Gura et al.
6,270,412 B1 8/2001 Crawford et al.
6,287,200 B1 9/2001 Sharma
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,319,124 B1 11/2001 Baerlocher
6,322,078 B1 11/2001 Adams
6,328,649 B1 12/2001 Randall et al.
6,334,814 B1 1/2002 Adams
6,347,996 B1 2/2002 Gilmore et al.
6,354,946 B1 3/2002 Finn
6,358,150 B1 3/2002 Mir et al.
6,364,766 B1 4/2002 Anderson et al.
6,383,074 B1 5/2002 Boggs
6,398,218 B1 6/2002 Vancura
6,398,220 B1 6/2002 Inoue
6,402,614 B1 6/2002 Schneier et al.
6,409,602 B1 6/2002 Wiltshire et al.
6,425,828 B2 7/2002 Walker et al.
6,435,511 B1 8/2002 Vancura et al.
6,439,993 B1 8/2002 O'Halloran
6,439,995 B1 8/2002 Hughs-Baird et al.
6,450,887 B1 9/2002 Mir et al.
6,454,649 B1 9/2002 Mattice et al.
6,461,241 B1 10/2002 Webb et al.
6,471,208 B2 10/2002 Yoseloff et al.
6,494,454 B2 12/2002 Adams
6,517,432 B1 2/2003 Jaffe
6,551,187 B1 4/2003 Jaffe
6,561,900 B1 5/2003 Baerlocher et al.
6,569,015 B1 5/2003 Baerlocher et al.
6,575,830 B2 6/2003 Baerlocher et al.
6,589,114 B2 7/2003 Rose
6,595,854 B2 7/2003 Hughs-Baird et al.
6,604,740 B1 8/2003 Singer et al.
6,616,142 B2 9/2003 Adams
6,659,864 B2 12/2003 McGahn et al.
6,676,512 B2 1/2004 Fong et al.
D487,582 S 3/2004 McGahn et al.
6,715,756 B2 4/2004 Inoue
6,726,204 B2 4/2004 Inoue
6,749,510 B2 6/2004 Giobbi
6,854,732 B2 2/2005 Moody
6,855,054 B2 2/2005 White et al.
6,855,056 B2 2/2005 Inoue
6,857,958 B2 2/2005 Osawa
6,866,583 B2 3/2005 Glavich et al.
D504,473 S 4/2005 Baerlocher
6,880,826 B2 4/2005 Inoue
6,884,162 B2 4/2005 Raverdy et al.
6,884,170 B2 4/2005 Rowe
6,884,171 B2 4/2005 Eck et al.
6,884,173 B2 4/2005 Gauselmann
6,885,057 B2 4/2005 Osada et al.
6,893,018 B2 * 5/2005 Inoue ..... 273/143 R
6,905,406 B2 6/2005 Kaminkow et al.
6,910,965 B2 6/2005 Downes
6,939,234 B2 9/2005 Beatty
6,942,571 B1 9/2005 McAllister et al.
6,991,544 B2 1/2006 Soltys et al.
7,003,548 B1 2/2006 Barck et al.
2001/0036857 A1 11/2001 Mothwurf et al.
2001/0044337 A1 11/2001 Rowe et al.
2002/0045484 A1 4/2002 Eck et al.
2002/0052233 A1 5/2002 Gauselmann
2002/0068631 A1 6/2002 Raverdy et al.
2002/0071557 A1 6/2002 Nguyen
2002/0086725 A1 7/2002 Fasbender et al.
2002/0094857 A1 7/2002 Meyer
2002/0094862 A1 7/2002 Inoue
2002/0116615 A1 8/2002 Nguyen et al.
2002/0137217 A1 9/2002 Rowe
2002/0138594 A1 9/2002 Rowe
2002/0142829 A1 10/2002 Inoue
2002/0193160 A1 12/2002 Tarantino
2003/0027622 A1 2/2003 Osawa
2003/0040355 A1 2/2003 Baerlocher
2003/0232643 A1 12/2003 Inoue
2004/0000754 A1 1/2004 Inoue
2004/0009803 A1 1/2004 Bennett et al.
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0023714 A1 2/2004 Asdale
2004/0026854 A1 2/2004 Inoue
2004/0036218 A1 2/2004 Inoue
2004/0038726 A1 2/2004 Inoue
2004/0041340 A1 3/2004 Inoue
2004/0053658 A1 3/2004 Rothkranz
2004/0058727 A1 3/2004 Marks et al.
2004/0121840 A1 6/2004 Rosander et al.
2004/0155399 A1 8/2004 Inoue
2004/0183251 A1 9/2004 Inoue
2005/0043083 A1 2/2005 Inoue
2005/0043084 A1 2/2005 Inoue
2005/0059477 A1 3/2005 Baerlocher
2005/0059478 A1 3/2005 Peterson et al.
2005/0277460 A1 12/2005 Inoue
2006/0019738 A1 1/2006 Baerlocher et al.
2006/0046830 A1 3/2006 Webb
2006/0084492 A1 4/2006 Baerlocher et al.

2006/0084498 A1 4/2006 Baerlocher et al.

FOREIGN PATENT DOCUMENTS

| | | | |
|---|---|---|---|
| AU | 199716432 | B2 | 9/1997 |
| AU | 199717601 | | 9/1997 |
| AU | 199650327 | B2 | 10/1997 |
| AU | 199747657 | B2 | 6/1998 |
| AU | 199917318 | B2 | 9/1999 |
| DE | 31 05 266 | | 9/1982 |
| DE | 31 05 266 | A1 | 9/1982 |
| DE | 3700861 | A1 | 7/1988 |
| EP | 0 060 019 | A1 | 9/1982 |
| EP | 0 410 789 | | 7/1990 |
| EP | 0 798 676 | A1 | 10/1997 |
| EP | 0 843 272 | A1 | 5/1998 |
| EP | 0 926 645 | A2 | 6/1999 |
| EP | 0 944 030 | A2 | 9/1999 |
| EP | 0 945 837 | A2 | 9/1999 |
| EP | 0 984 408 | | 3/2000 |
| EP | 1 004 970 | | 5/2000 |
| EP | 1 184 822 | A3 | 3/2002 |
| EP | 1 296 296 | A2 | 3/2003 |
| GB | 1 464 896 | A1 | 1/1974 |
| GB | 2 083 936 | A | 3/1982 |
| GB | 2 090 690 | A | 7/1982 |
| GB | 2 096 376 | A | 10/1982 |
| GB | 2 097 160 | A | 10/1982 |
| GB | 2 100 905 | A | 1/1983 |
| GB | 2 101 380 | A | 1/1983 |
| GB | 2 105 891 | A | 3/1983 |
| GB | 2 106 292 | A | 4/1983 |
| GB | 2106292 | | 4/1983 |
| GB | 2 117 155 | A | 10/1983 |
| GB | 2 137 392 | A | 10/1984 |
| GB | 2 161 008 | A | 1/1986 |
| GB | 2 170 636 | A | 8/1986 |
| GB | 2 180 087 | A | 3/1987 |
| GB | 2 181 589 | A | 4/1987 |
| GB | 2 183 882 | A | 6/1987 |
| GB | 2 191 030 | A | 12/1987 |
| GB | 2 222 712 | A | 3/1990 |
| GB | 2 225 889 | A | 6/1990 |
| GB | 2 226 436 | A | 6/1990 |
| GB | 2 242 300 | A | 9/1991 |
| GB | 2 262 642 | A | 6/1993 |
| GB | 2 328 311 | A | 2/1999 |
| GB | 2 378 664 | | 2/2003 |
| WO | WO 97/32285 | | 9/1997 |
| WO | WO 97/43846 | | 11/1997 |
| WO | WO 98/35309 | | 8/1998 |
| WO | WO 99/41718 | | 8/1999 |
| WO | WO 00/25281 | | 5/2000 |
| WO | WO 00/59591 | | 10/2000 |
| WO | WO 00/66235 | | 11/2000 |
| WO | WO 00/76606 | | 12/2000 |
| WO | WO 03/045518 | | 6/2003 |
| WO | WO 2005/081623 | | 9/2005 |

OTHER PUBLICATIONS

Barn Yard article, written by Strictly Slots, published in Mar. 2002.
Barn Yard advertisement, written by Aristocrat, available prior to Aug. 26, 2005.
Bonus Times article, written by Strictly Slots, published in Jul. 2000.
Easy Street website pages available at www.csds.com/Gaming/Products/g_Easy.htm, printed on Jan. 15, 2001.
Magic 8 Ball advertisement, written by IGT, published in 2002.
Penguin Pays advertisement, written by Aristocrat, published in 1998.
Reel Magic Gaming Machine description, written by IGT, published in 1986.
Take Your Pick advertisement, written by IGT, published in 1999.
Take Your Pick article, written by Strictly Slots, published in Mar. 2001.
Treasure Wheel/Treasure Tunnel advertisement, written by Sigma Game, Inc., available prior to Aug. 26, 2005.
Vision Series/Good Times brochure, written by IGT, published in 1999.
Wheel of Fortune advertisement, written by IGT, published in 1998.
Wheel of Fortune advertisement, written by IGT, published in 1999.
Wild Streak advertisement, written by WMS Gaming, Inc., available prior to Aug. 26, 2005.
Wild Streak article, written by Strictly Slots, published in Mar. 2001.
X Factor brochure, written by WMS Gaming, Inc., available prior to Aug. 26, 2005.
X Factor website Pages available at www.wmsgaming.com/products/slot/xft/index.html, printed on Jan. 15, 2001 and www.wmsgaming.com/products/slot/xft/howto/html, printed on May 22, 2001.
Little Devils Brochure written by IGT, published in 1998.
Marshall Fey, Slot Machines a pictorial History of the First 100 Years, 1983, Liberty Belle Books, pp. 79, 150, 171, 231.
Slot Machines written by Reno-Tahoe Specialty, Inc., published in 1989.
Totem Pole Brochure written by IGT, published in 1997.
Tropical Fever Glass written by IGT, published prior to 2006.
Winning Streak Brochure written by Aristocrat, published in 1994.

* cited by examiner

GAMING DEVICE HAVING PHYSICAL CONCENTRIC SYMBOL GENERATORS WHICH ARE OPERABLE TO PROVIDE A PLURALITY OF DIFFERENT GAMES TO A PLAYER

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming device manufacturers strive to make wagering gaming devices that provide as much enjoyment, entertainment and excitement as possible for players. Providing interesting and exciting primary or base games and secondary or bonus games in which a player has an opportunity to win potentially large awards or credits is one way to enhance player enjoyment and excitement. Certain known gaming devices use mechanical devices, such as reels, to enhance the attraction of the machines to players and also to enhance the player's game playing experience. These mechanical devices enable a player to see physical movements of a game, a portion of a game, or a functional game event or element which increases the player's enjoyment of the game.

One known gaming device includes the generation of one or more symbols using one or more symbol generators, such as reels. In these slot machine gaming devices, the symbol generators each include a plurality of symbols. In this type of gaming device, if the player achieves a predetermined symbol or combination of symbols on the reels, the player wins an award. If the combination of symbols indicated on the reels is not a predetermined symbol or symbol combination, the gaming device does not provide an award to the player.

Such known gaming devices are typically dedicated to one type of game (e.g., a slot machine game, a poker game, a blackjack game), wherein their physical appearance are customized for the game provided. However, while some players prefer to repeatedly use one or a few favorite types or styles of gaming devices, many players enjoy trying out different types of games that appear new to them (i.e., which have a new or different type of game and/or prize structure). For example, at least some players may be more likely to play a gaming device if they perceive that the gaming device has a different configuration, compared to the configuration during the previous time the player played the gaming device.

Such known gaming devices may be modified to provide a different type of game, such as by converting a slot machine gaming device into a poker game gaming device or a blackjack gaming device. However, this typically requires hardware modifications to be performed (i.e., changing the mechanical or electromechanical reel sets utilized by the gaming device or changing an electronic card on which the game program is stored). Accordingly, gaming systems have been devised wherein a cluster of one or more gaming devices are in communication with a central server or controller. The central server stores a plurality of different game programs and communicates or "downloads" one or more of the stored game programs to one, more or each of the gaming devices in the cluster. In these gaming systems, when a game program is communicated to a gaming device, the gaming device executes the communicated program, thereby changing the type of game played at the gaming device.

When a slot machine gaming device includes a video display that displays one or more non-physical symbol generators, such as video reels, the conversion from a first game or type of slot machine game which utilizes one set of symbols on a set of symbol generators (such as reels) to a second game or type of slot machine game which utilizes another set of symbols on another set of symbol generators (which may or may not be the same set of symbol generators as the first game) is a relatively simple conversation. That is, the game program communicated from the central controller to the gaming device includes instructions or other suitable information regarding the appropriate non-physical symbol generator or reel configuration (i.e., a reel mapping of the symbols located on each non-physical reel) and the non-physical reel is used in a play or execution of the communicated game program. It should be appreciated that utilizing a video display, a first type of slot machine game may also be converted to a second type of poker, blackjack or other non-slot machine game simply by communicating a different game program from the central controller to the gaming device.

On the other hand, when a slot machine gaming device includes physical symbol generators, such as electromechanical or mechanical reels, the conversion from a first game or type of slot machine game which utilizes one set of symbols to a second game or type of slot machine game which utilizes another set of symbols presents many problems. One problem is that the physical symbol generators may not be altered or modified simply by a central controller communicating a different game program to the gaming device. Unlike a slot machine game with a video display which displays video or non-physical reels (wherein information regarding the utilized set of reels is included with the communicated game program), the configuration of the physical symbol generators is fixed and does not change regardless of which game program is communicated to the gaming device. Accordingly, in known gaming devices with physical symbol generators, any different game programs communicated to the gaming device must utilize the same physical symbol generators.

Concentric reels implemented on gaming devices for providing a single game are also known. A concentric reel includes an inner reel and at least one outer reel which are aligned on substantially the same rotational axis. The outer reel includes a plurality of symbols and at least one window. The inner reel includes a plurality of symbols. In a play of the game, the concentric reels are activated to cause the inner reel and the outer reel to move or rotate. When the inner and outer reel stop, one of the symbols of the outer reel or the window is indicated by a payline associated with the concentric reel. If the window is present on the payline, the symbol on the inner reel on the payline is viewable through the indicated window. The indicated symbol on the inner reel is part of the evaluated symbol combination with the other symbols of the other reels indicated by the payline. The gaming device provides an outcome, such as an award for any winning symbol or symbol combination associated with these symbols indicated by the payline. Accordingly, the different viewable areas or windows increase a player's excitement and enjoyment of the game because a player does not know which symbols will be visible or viewable through the viewable areas or windows and therefore the player does not know which symbol combinations will occur on the reel sets until the reel sets stop moving in a play of a game. It should thus be appreciated that symbols included on the inner reel and the outer reel are utilized for the play of one game.

Therefore, to increase player enjoyment and excitement, it is desirable to provide players with a gaming system wherein a plurality of gaming devices with physical reels may be utilized to each execute a plurality of different game programs.

SUMMARY

The present disclosure relates in general to a gaming device having physical concentric symbol generators, wherein the gaming device is operable to interchangeably provide a plurality of different games to a player. In one embodiment, the present disclosure relates to a gaming system with a central server or controller operable to communicate a plurality of different game programs to one, more or each of the gaming devices, wherein each gaming device executes the communicated game program by utilizing one or more concentric symbol generators to provide different games which utilize one, more or each of the symbols from a fixed set of symbols associated with the symbol generators.

In one embodiment, the gaming device includes a plurality of physical symbol generators, such as mechanical or electromechanical reels. Each symbol generator includes one or more symbols. One, more or each of the symbol generators include concentric members or concentrically arranged members. Each concentric symbol generator includes an inner member with a plurality of symbols. Each concentric symbol generator also includes one or more outer members which each define one or more viewable areas or windows and which may include zero, one or more symbols.

In operation, upon a suitable triggering event, one of a plurality of game programs are selected. The game programs may be selected from a memory device of the gaming device or alternatively by a central controller (and subsequently communicated to one or more designated gaming devices). Each game program represents a different configuration, set of instructions or type game, executable by a gaming device processor to control the play of one or more games. In different embodiments, the selected game program is determined based on a player's selection, predetermined, randomly determined, determined based on the player's wager, determined based on the player's status (such as determined through a player tracking system), determined based on a level of a jackpot award, determined based on time (such as the time of day or how long the current game program has been playing) or determined based on any other suitable method.

After an appropriate game program is selected, the gaming device executes the selected game program utilizing one or more of the physical symbol generators. In one embodiment, the specific selected game program dictates the functionality and operability of the physical symbol generators. In this embodiment, upon the execution of the selected game program, the inner member and/or outer member(s) of one, more or each of the concentric symbol generators are activated to move or rotate.

In one embodiment, the gaming device utilizes one or more display devices to display information to the player regarding which game program is selected. Each game program is associated with certain information, such as which game program is being played, the applicable paytable for the game being played, the instructions of how the game is played or any other suitable information. In this embodiment, the information associated with the selected game program is displayed to the player. It should be appreciated that any other suitable information, such as any other available game program(s), the paytables applicable for other game program(s), the instructions of how the other game(s) are played or information relating to any primary game or any secondary games, may also be displayed to the player using one or more display devices.

In one embodiment, the specific selected game program dictates which symbols may be generated by the gaming device during the execution of the selected game program. As described above, since each of the physical symbol generators include a plurality of symbols, the plurality of symbols included in (or adapted to be generated by) each of the symbol generators form a fixed set of symbols. This fixed set of symbols represents the total symbols which may be used by the gaming device in the execution of the different game programs. It should be appreciated that while one or more of the game programs may utilize (or otherwise be associated with) any of the symbols from the fixed set of symbols, one or more of the game programs may each utilize (or otherwise be associated with) different subsets of the fixed set of symbols. That is, as described in more detail below, if a game program is associated with a subset of symbols, only the symbols included in the subset of symbols may be generated by the gaming device during the execution of the game program. In one embodiment, a plurality of game programs each utilize different sub-sets of symbols by activating different numbers of symbol generators. For example, one selected game program utilizes three symbol generators (and thus the subset of symbols includes the symbols associated with the three utilized symbol generators) and another selected game program may be associated with a subset of symbols which includes the symbols on two inner members and one outer member (and thus the subset of symbols includes the symbols associated with the two utilized inner members and the one utilized outer member). As described in more detail below, another game program may be associated with a subset of symbols which includes designated symbols on one, more or each of the inner members. It should be appreciated that any suitable combination of symbols from the fixed set of symbols may be utilized as an appropriate subset of symbols.

In another embodiment, the specific selected game program dictates the function of each of the symbols of the physical symbol generators. In another embodiment, the specific selected game program dictates the number of and type of symbols which will be utilized. In another embodiment, the specific selected game program dictates the paytable utilized. It should be appreciated that since the symbol generators are physical, each different game program utilizes the same physical symbol generators in a different way.

In one embodiment, the selected game program determines whether the inner member and/or one, more or each of the outer members of each concentric symbol generator will be activated. For example, for a first selected game program, one, more or each of the outer members will be activated to spin or move to generate one of the symbols of the outer member or the window of the outer member. On the other hand, for a second selected game program, none of the outer members are activated to spin or move.

In one embodiment, different game programs are utilized to alter, substitute or interchange the symbols which may be generated by the physical symbol generators. In this embodiment, the inner member of each concentric symbol generator includes a plurality of symbols, wherein the plurality of symbols are grouped into a plurality of different symbol subsets. Each individual symbol subset is associated with or used for one or more of the game programs which may be selected to be executed. In this embodiment, the physical symbol subset which the gaming device processor will utilize for the play of any particular game is dependent on which executable game program is selected. That is, only the symbols included in the symbol subset associated with the selected game program may be generated on the inner member in a position viewable through a window of the outer member. For example, if a first game program (i.e., a first game or type of game) is selected and the first game program is associated with a first subset of physical symbols of the inner member, then only the symbols from the first subset of symbols will be available to be generated on the inner member during the execution or play of the first game program. On the other hand, if a second game program (i.e., a second game or type of game) is selected and the second game is associated with a second different subset of physical symbols of the inner member, then only the symbols from the second different subset of symbols will be available to be generated on the inner member during the execution or play of the second game program.

Accordingly, by storing a plurality of different game programs and selecting, on demand, one or more game programs to be executed, the gaming device disclosed herein provides that multiple different types of different games may be played utilizing physical symbol generators which include a fixed set of symbols.

In one embodiment, a plurality of the gaming devices described above are in communication with or linked to the central server or controller to form a gaming system. The central server or controller may be any suitable server or computing device which includes a processor and a memory or storage device. In one embodiment, the central server or controller is operable to store a plurality of different executable game programs. In this embodiment, as described above, each game program represents a different setting, configuration or type game which may be played on one, more or each of the gaming devices in the gaming system.

In one embodiment, the central controller selects the game program to be played and executes the selected game program. As described above, the selected game program is determined based on a player's selection, predetermined, randomly determined, determined based on the player's wager, determined based on the player's status (such as determined through a player tracking system), determined based on a level of a jackpot award, determined based on time (such as the time of day or how long the current game program has been playing) or determined based on any other suitable method. In this embodiment, the gaming device is utilized to display the game program (executed by the central controller) and provide any award to the player.

In another embodiment, as described below, one or more selected game program(s) are communicated from the central controller to one or more gaming devices. In different embodiments, the central controller selects one or more game programs at designated intervals, such as based on time or the amount wagered at one or more gaming devices in the gaming system, and communicates the selected game program(s) to one or more gaming devices. In this embodiment, at least one communicated game program is selected and such selected game program is executed by the gaming device. As described above, the selected game program is determined based on a player's selection, predetermined, randomly determined, determined based on the player's wager, determined based on the player's status (such as determined through a player tracking system), determined based on a level of a jackpot award, determined based on time (such as the time of day or how long the current game program has been playing) or determined based on any other suitable method.

In operation of this embodiment, the central server or controller determines and selects one of a plurality of executable game programs from a stored set or pool of game programs. As described above, in different embodiments, the selected game program is determined based on a player's selection, predetermined, randomly determined, determined based on the player's wager, determined based on the player's status (such as determined through a player tracking system), determined based on a level of a jackpot award, determined based on time (such as the time of day or how long the current game program has been playing) or determined based on any other suitable method. In one embodiment, the selected game program is communicated to one, more or each gaming devices in the gaming system. In this embodiment, the gaming device which the selected game program was communicated to executes the selected game program as described above.

It should be appreciated that this embodiment allows the central controller to control aspects of the reels operability and/or game functionality results in a plurality of dynamic games changeable via the central controller. Accordingly, the gaming system disclosed herein provides a server based gaming device which alters or modifies the use of one, more or each physical symbol generators based on which different game program is executed.

Additional features and advantages are described in, and will be apparent from, the following Detailed Description and the figures.

DETAILED DESCRIPTION

The present disclosure relates in general to a gaming device having physical symbol generators, wherein the gaming device provides a plurality of different games to a player which each utilize the same physical symbol generators. The present disclosure further relates to a gaming system with a central server or controller operable to communicate a plurality of different game programs to one, more or each gaming devices, wherein each gaming device executes the communicated game program by utilizing one or more physical symbol generators.

In one embodiment, as described in more detail below, the gaming device includes a memory device which stores different game programs and instructions, executable by a gaming device processor, to control the gaming device. Each executable game program represents a different type of game or game configuration which may be played by the gaming device. In this embodiment, upon a suitable triggering event, one of the plurality of game programs are selected. The gaming device executes the selected game program utilizing one, more or each physical symbol generators, wherein the selected game program dictates the functionality and operability of the physical symbol generators for the type of game selected.

Figure 1:
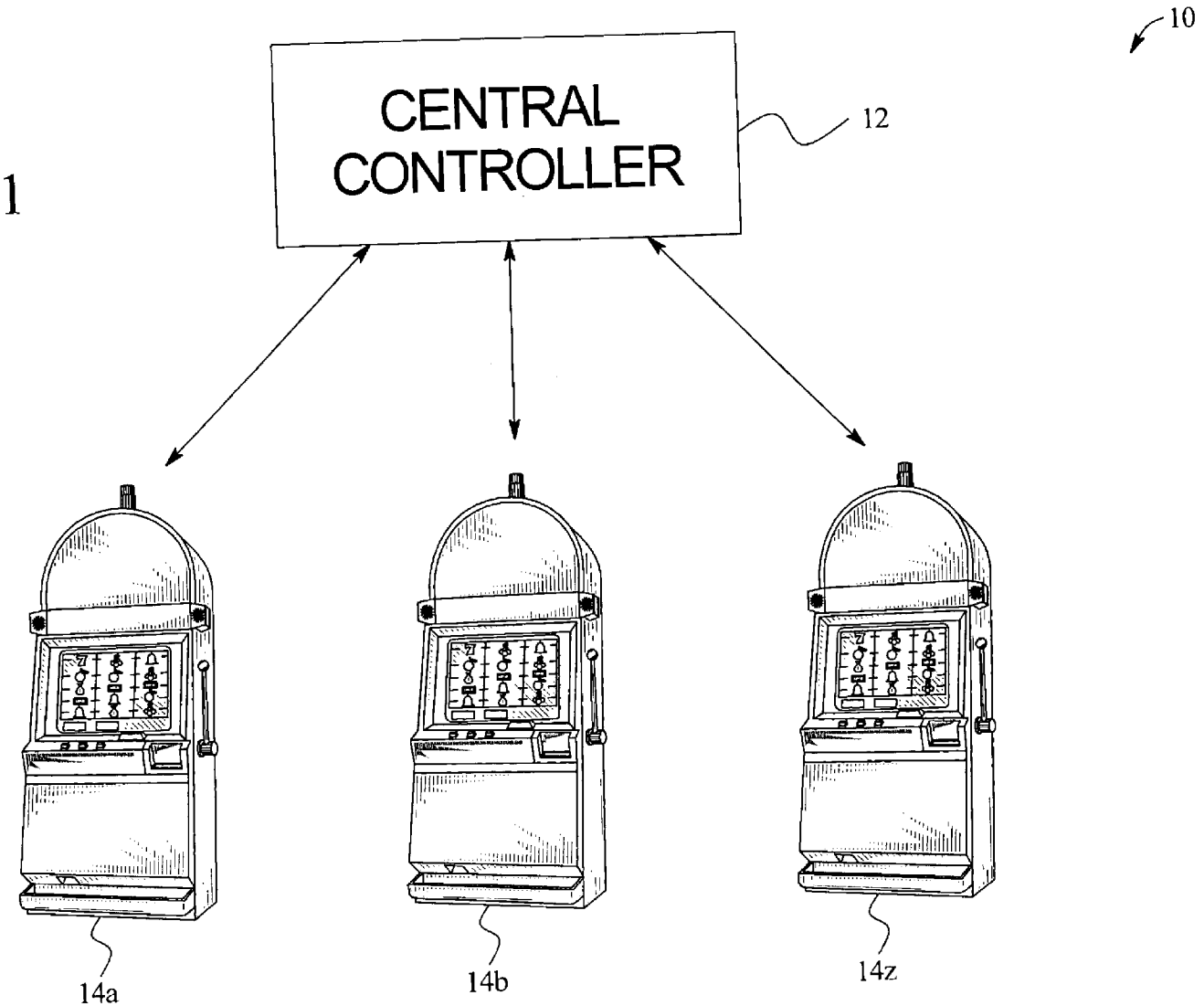
FIG. 1 is a schematic diagram of the central controller in communication with a plurality of gaming machines in accordance with one embodiment disclosed herein.

Referring to FIG. 1, in one embodiment a plurality of gaming machines or gaming devices 14*a*, 14*b* . . . 14*z* are in communication with or linked to a central server or processor 12 to form a gaming system 10. In this embodiment, the game program to be executed by one, more or each of the gaming devices is selected by the central server and communicated to the appropriate gaming device. The number of gaming machines in the gaming system can vary as desired by the implementer of the gaming system. These gaming machines are referred to herein alternatively as the group of gaming machines, the linked gaming machines or the system gaming machines. The play of each of the gaming machines 14*a*, 14*b* . . . 14*z* in the group is determined, at least in part, by the central server 12.

The central server or controller may be any suitable server or computing device which includes a processor and a memory or storage device. In alternative embodiments, the central server is a progressive controller or another gaming machine in the gaming system. In one embodiment, the memory device stores different game programs and instructions, executable by a gaming device processor, to control the gaming device. Each executable game program represents a different type game which may be played on one, more or each of the gaming devices in the gaming system. That is, at least two different game programs utilize at least two different symbol sets. As described in more detail below, different types of game programs will assign different functions to the same symbols, utilize different pay tables, interchange different physical symbol subsets utilized on one, more or each of the reels, utilize different reel mappings or modify any appropriate aspect of game play.

The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming system disclosed herein.

In one embodiment, a gaming device processor of each gaming device may be designed to facilitate transmission of signals between the individual gaming device and the central server or controller. In one embodiment, the data network is a local area network (LAN), in which one, more or each of the gaming devices are substantially proximate to each other and an on-site central server or controller as in, for example, a gaming establishment or a portion of a gaming establishment. In another embodiment, the data network is a wide area network (WAN) in which one, more or each of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of each gaming device can be viewed at that gaming device with at least one internet browser. In this embodiment, operation of each gaming device and accumulation of credits may be accomplished with only a connection to the central server or controller (the internet/intranet server), through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

Figure 2A:
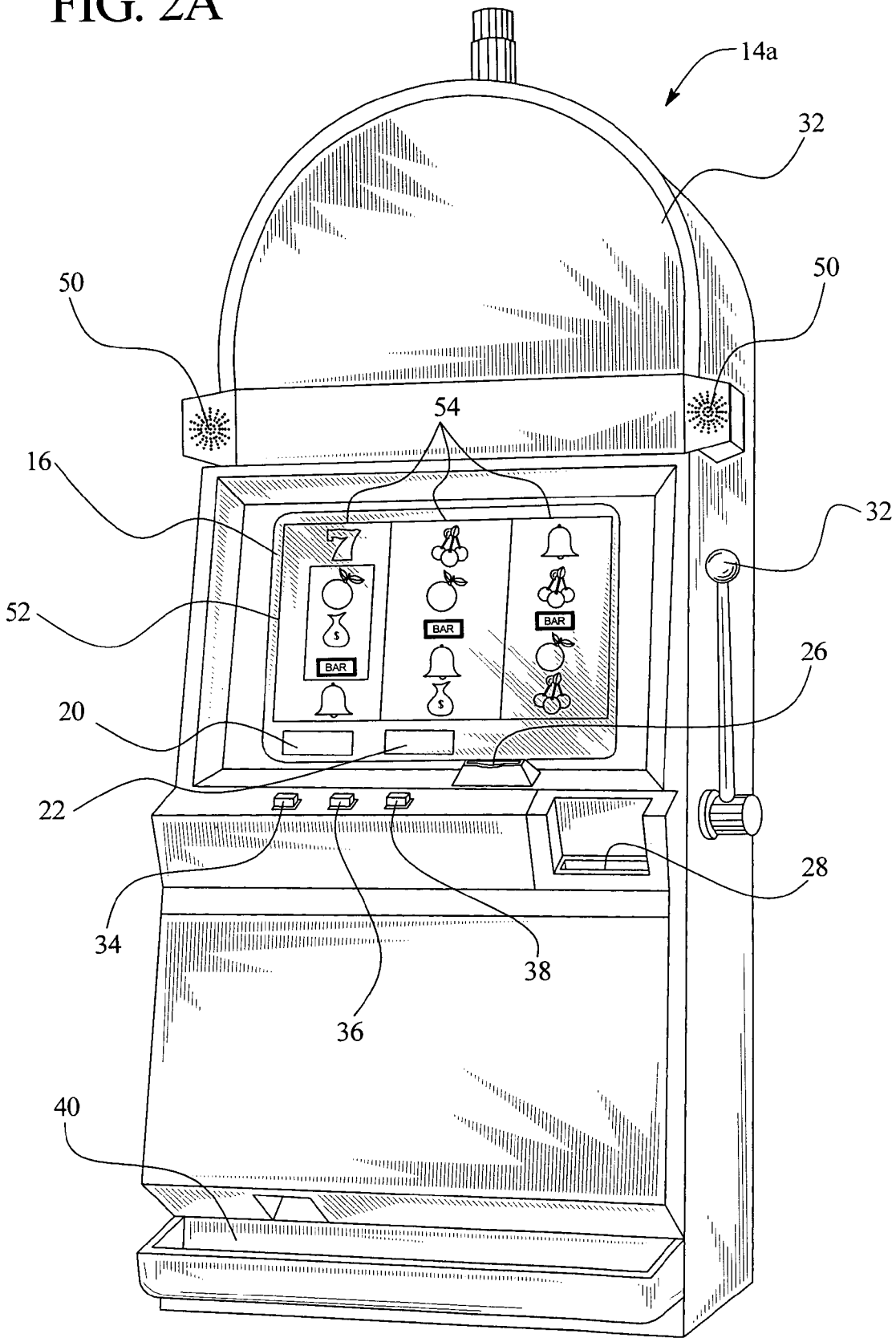
FIGS. 2A and 2B are perspective views of alternative embodiments of the gaming device disclosed herein.
Figure 2B:
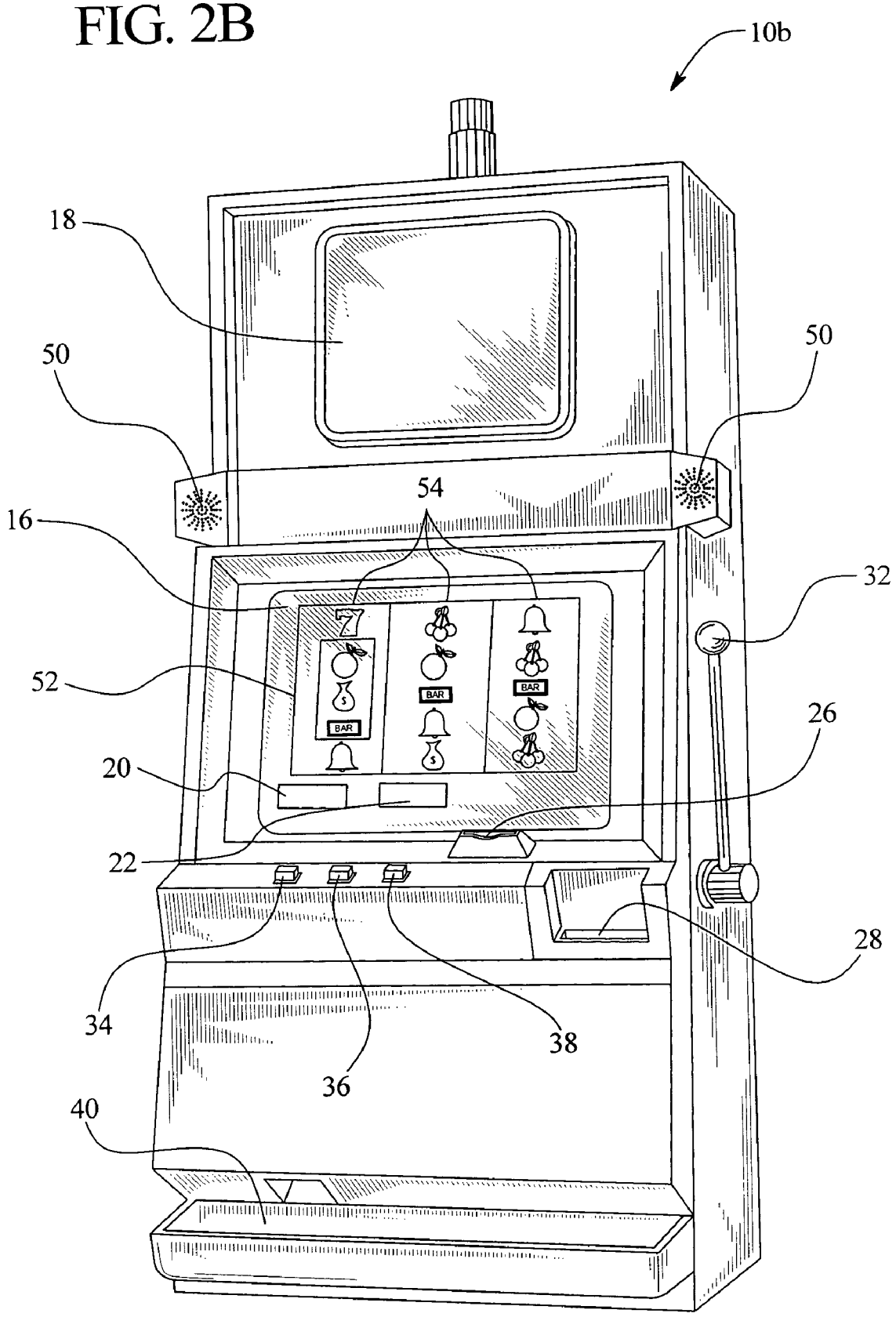

Two alternative embodiments of the gaming devices of the gaming system are illustrated in FIGS. 2A and 2B as gaming device 14*a* and gaming device 14*b*, respectively. Gaming device 14*a* and/or gaming device 14*b* are generally referred to herein as gaming device 14.

In one embodiment, as illustrated in FIGS. 2A and 2B, each gaming device in the gaming system has a support structure, housing or cabinet which provides support for a plurality of displays, inputs, controls and other features of a conventional gaming machine. It is configured so that a player can operate it while standing or sitting. Each gaming device may be positioned on a base or stand or can be configured as a pub-style table-top game (not shown) which a player can operate preferably while sitting. As illustrated by the different configurations shown in FIGS. 2A and 2B, the gaming device may have varying cabinet and display configurations.

Figure 3:
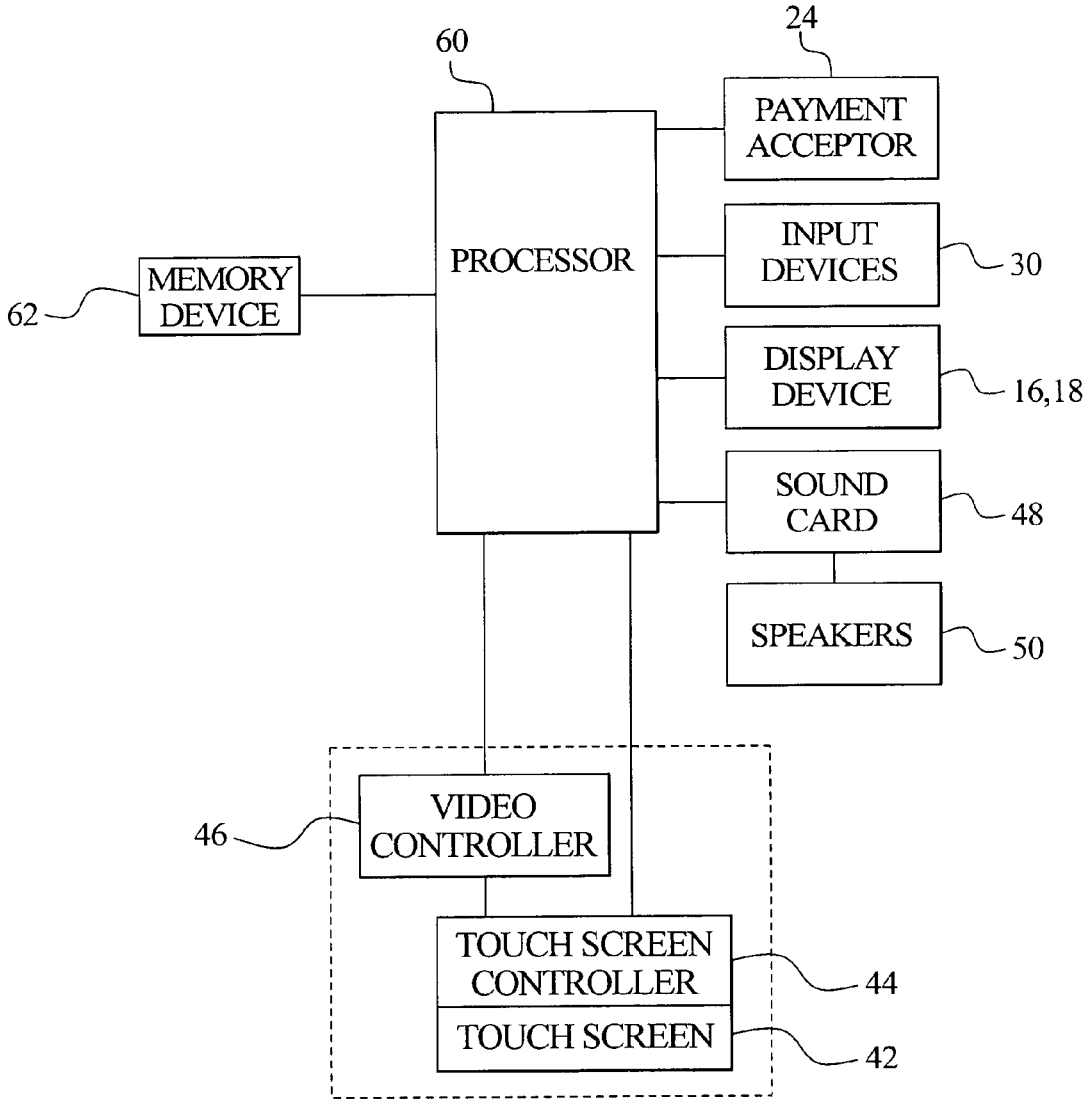
FIG. 3 is a schematic block diagram of an electronic configuration of one embodiment of the gaming device disclosed herein.

In one embodiment, as illustrated in FIG. 3, each gaming device in the gaming system at least includes at least one gaming device processor 60, such as a microprocessor, a microcontroller-based platform, a suitable integrated circuit or one or more application-specific integrated circuits (ASIC's). In one embodiment, the gaming device processor is in communication with or operable to access or to exchange signals with at least one local data storage or local memory device 62. In one embodiment, the gaming device processor and the local memory device reside within the cabinet of the gaming device.

In one embodiment, the local memory device stores, at least in part, program code and instructions, executable by the gaming device processor, to control the gaming device. The local memory device may also store, at least in part, other data such as image data, event data, player input data, random or pseudo-random number generators, pay-table data or information and applicable game rules that relate to the play of the gaming device. In one embodiment, the local memory device includes random access memory (RAM). In one embodiment, the local memory device includes read only memory (ROM). In one embodiment, the local memory device includes flash memory and/or EEPROM (electrically erasable programmable read only memory).

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as illustrated in FIG. 2A, the gaming devices of the gaming system each include one or more display devices controlled by the gaming device processor and/or the central server. The display devices are preferably connected to or mounted to the cabinet of the gaming device. The embodiment shown in FIG. 2A includes a central display device 16 which displays a primary game. This display device may also display any secondary game associated with the primary game as well as information relating to the primary or secondary game. The alternative embodiment shown in FIG. 2B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables play of at least a portion of the primary or secondary game at a location remote from the gaming device. As seen in FIGS. 2A and 2B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs) or any other suitable electronic device or display mechanism. In one embodiment, as described in more detail below, the display device includes a touch-screen with an associated touch-screen controller. The display devices may be of any suitable configuration, such as a square, rectangle, elongated rectangle. In another embodiment, one or more display device may be a movable display which includes information, such as information about all the game programs which may be played. In one embodiment, the movable display includes two rollers and a belt which frictionally engages the rollers. The information regarding the different available games are on different sections of the belt, wherein the belt is configured such that each of such sections may be displayed sequentially to a player. In this embodiment, each section corresponds to a different game which may be played at the gaming device. A drive roller which is powered by a suitable motor coupled to the drive roller, rotates the belt in a clockwise, counter-clockwise or any suitable combination of directions. The processor in the gaming device (or the central controller) controls the drive roller and causes the drive roller to move to sequentially display one or more sections and thus display information regarding one or more games played. It should be appreciated that any suitable display device may be employed to display such information to a player.

In one embodiment, the gaming device utilizes one or more of the display devices to display information to the player regarding which game program is selected.

In one embodiment, the gaming device utilizes one or more display devices to display information to the player regarding which game program is selected. That is, each game program is associated with certain information, such as which game program is being played, the applicable paytable for the game being played, the instructions of how the game is played or any other suitable information. In this embodiment, the information associated with the selected game program is displayed to the player. For example, the gaming device may utilize at least one movable display to indicate information regarding which game program is selected. It should be appreciated that any other suitable information, such as any other available game program(s), the paytables applicable for other game program(s), the instructions of how the other game(s) are played or information relating to any primary game or any secondary games, may also be displayed to the player using one or more display devices.

The display devices of the gaming devices of the gaming system are configured to display at least one and preferably a plurality of game or other suitable images, symbols and indicia such as any visual representation or exhibition of the movement of objects such as mechanical or video reels and wheels, dynamic lighting, video images, images of people, characters, places, things and faces of cards, tournament advertisements and the like.

In another embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 3, in one embodiment, the gaming devices of the gaming system each include at least one payment acceptor 24 in communication with the gaming device processor. As seen in FIGS. 2A and 2B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the gaming device processor determines the amount of funds entered and displays the corresponding amount on the credit or other suitable display as described above.

As seen in FIGS. 2A, 2B and 3, in one embodiment the gaming devices of the gaming system each include at least one and preferably a plurality of input devices 30 in communication with the gaming device processor and/or the central server. The input devices can include any suitable device which enables the player to produce an input signal which is read by the gaming device processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 2A and 2B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 3, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming devices of the gaming system may each further include a plurality of communication ports for enabling communication of the gaming device processor with external peripherals, such as external video sources, expansion buses, game or other displays, an SCSI port or a key pad.

In one embodiment, as seen in FIG. 3, the gaming devices of the gaming system each include a sound generating device controlled by one or more sounds cards 48 which function in conjunction with the gaming device processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming devices of the gaming system each include a sensor, such as a camera, in communication with the gaming device processor (and possibly controlled by the gaming device processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the gaming device processor may incorporate that image into the primary and/or secondary game as a game image, symbol or indicia.

In another embodiment, the gaming devices of the gaming system can each incorporate any suitable primary or secondary game. The gaming machine or device may include some or all of the features of conventional gaming machines or devices. The primary or secondary game may comprise any suitable reel-type game, card game, number game or other game of chance susceptible to representation in an electronic or electromechanical form which produces a random outcome based on probability data upon activation from a wager. That is, different games, such as video poker games, video blackjack games, video Keno, video bingo or any other suitable primary or secondary game may be implemented.

In one embodiment, as illustrated in FIGS. 2A and 2B, an executable game program communicated to the gaming device may be for a slot game with one or more symbol generators such as reel sets 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. Each reel set 54 displays a plurality of indicia such as bells, hearts, fruits, numbers, letters, bars or other images which preferably correspond to a theme associated with the gaming device. In this embodiment, the gaming device awards prizes when the reels stop spinning if specified types and/or configurations of indicia or symbols occur on an active payline 52 or otherwise occur in a winning pattern. The paylines may be horizontal, vertical, circular, diagonal, angled or any combination thereof.

Figure 4A:
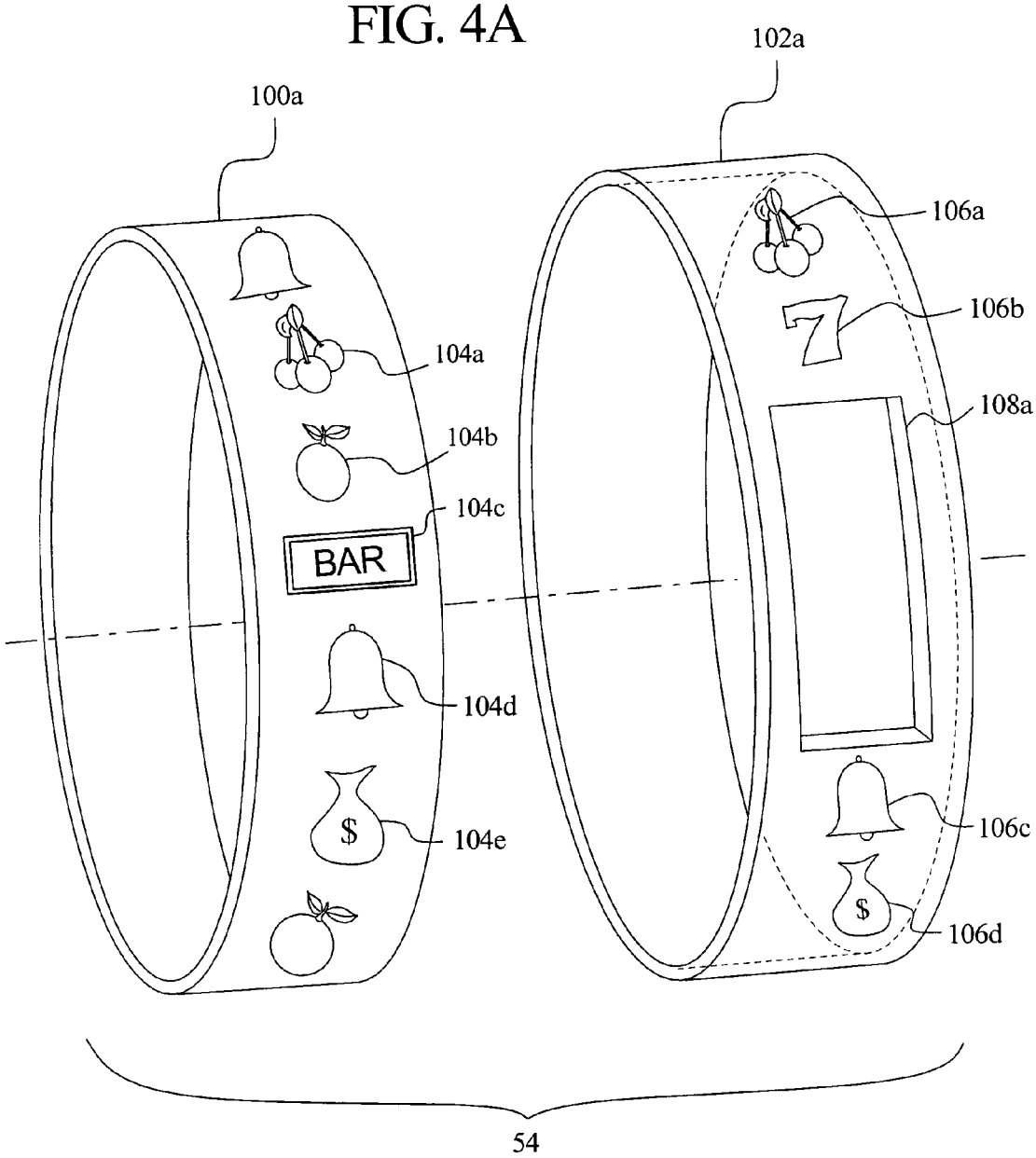
FIG. 4A is an enlarged exploded perspective view of one embodiment of a reel set disclosed herein, wherein the reel set includes an inner reel and an outer reel.

In one embodiment, as illustrated in FIG. 4A, one, more or each of the symbol generators includes an inner member 100*a*, such as an inner reel or inner sphere, and an outer member 102*a*, such as an outer reel or outer sphere. In one embodiment, the inner member 100 and the outer member 102 are fully or partially concentric reels or concentrically arranged reels and in electromechanical form with mechanical rotating reels. The inner member 100 fits at least partially within the outer member 102 and is adapted to move or rotate independently and freely within the outer member 102*a*. In one embodiment, the inner member 100*a* includes a plurality of symbols 104, such as a cherry symbol 104*a*, an orange symbol 104*b*, a bar symbol 104*c*, a bell symbol 104*d* and a money bag symbol 104*e*. It should be appreciated that the symbols 104 may be numbers, letters, characters, images or any other suitable symbols.

In one embodiment, the outer member 102 includes zero, one or a plurality of symbols, such as a cherry symbol 106*a*, a seven symbol 106*b*, a bell symbol 106*c* and a money bag symbol 106*d*. The outer member also includes or defines one or more viewable areas or windows 108*a* of different sizes and/or different positions which each can display one or more of the symbols on the inner member.

In one embodiment, the viewable areas are openings defined by the outer member which extend through the width or thickness of the outer member. In another embodiment, the viewable areas include a substantially transparent and/or translucent material such as a suitable glass or a suitable plastic which enables a player to see-through the cover to view the symbol or symbols 104 of the inner member 100*a*.

Figure 4B:
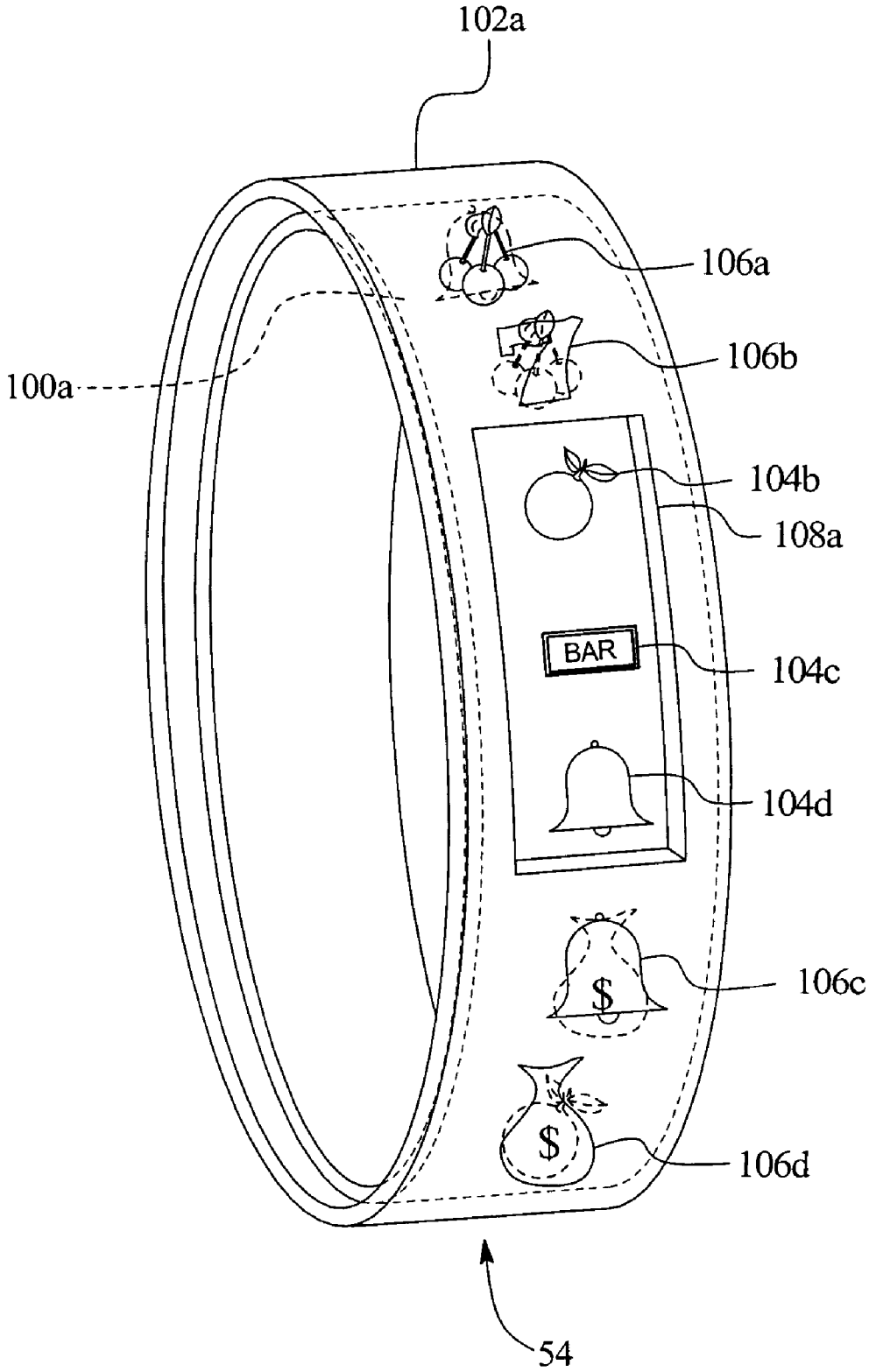
FIG. 4B is an enlarged exploded perspective view of the reel set of FIG. 4A wherein the inner reel is positioned within the outer reel.

FIG. 4B illustrates how the inner member 100*a* and the outer member 102*a* of a symbol generator set 54 co-act to display one or more symbols to a player. Specifically, the inner member 100*a* and the outer member 102*a* combine to form one of the reel sets 54, wherein the position of each of the window of the outer member affects how many symbols and which of any symbols from the inner member are displayed to a player. For example, window 108*a* displays the orange symbol 104*b*, the bar symbol 104*c* and the bell symbol 104*d*. In one embodiment, the inner member may be any suitable display, such as a video display, a mechanical reel, a rotatable display or rotatable belt, or any other suitable video or mechanical display. In another embodiment, the outer member may be any suitable display, such as a mechanical reel, a rotatable display or rotatable belt, or any other suitable mechanical display.

In one embodiment, when activated, the inner member and the outer member of the symbol generator set including the concentric inner and outer members may rotate simultaneously or sequentially. In one embodiment, the inner member 100*a* and the outer member 102*a* rotate in the same direction. In another embodiment, the inner member and the outer member rotate in different directions. It should be appreciated that the inner member 100*a* and the outer member 102*a* of each reel set including the concentric reels may rotate in a clockwise direction, counterclockwise direction or any combination of counterclockwise and clockwise directions. In one embodiment, the inner member 100*a* and the outer member 102*a* of at least one of the reel sets including the concentric reels rotate at the same rate of rotation. In another embodiment, the inner member and the outer member rotate at different rates of rotation.

In another embodiment, the inner member includes a plurality of symbol positions wherein one, more or each of the symbol positions includes two symbols at that position. In this embodiment, one symbol at the symbol position may be utilized for one game and another symbol at the symbol position may be utilized for another game. In another embodiment, the inner member includes at least two different symbol positions with symbols at different sides or locations at one or more of the symbol positions. For example, in one embodiment, the symbol located on the right side of the inner member may be utilized for a first game and the symbol located on the left side of the inner member may be utilized for a second game. In this embodiment, the outer member defines a plurality of viewable areas or windows which are also located in different positions or locations on the outer member of the reel set.

In another embodiment, the outer member includes or defines a plurality of viewable areas or windows wherein at least two of the windows are different sizes which are adapted to display different numbers of symbols in different executed games. For example, a first type of game may utilize single-symbol windows of the outer member (i.e., windows in which one symbol of the inner member is viewable through) and a second type of game may utilize single-symbol windows of the outer member and double-symbol windows of the outer member (i.e., windows in which two symbols of the inner member are viewable through). It should also be appreciated that the symbols may be conventional symbols, blank symbols (i.e., empty spaces) or any other suitable symbol or symbols or any suitable combination of symbols.

In one embodiment, an executable game program may be for a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the executable game program for the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game could be accomplished through a simple "buy in" by the player if, for example, the player has been unsuccessful at qualifying through other specified activities.

In one embodiment, after receiving an appropriate game program to execute, the gaming device randomly generates awards and/or other game outcomes based on probability data. In this embodiment, each award or other game outcome is associated with a probability and the generated award or other game outcome is based on the associated probabilities. It should be appreciated that since the outcomes are randomly generated or generated based upon a probability calculation, there is no certainty that the gaming device will ever provide the player with any specific award or other game outcome.

In one embodiment, the game outcome provided to the player is determined by the central server or controller and provided to the player at the gaming device. In this embodiment, upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome is determined for each of a plurality of linked or networked gaming devices based on the results of a bingo game. In this embodiment, each individual gaming device utilizes one or more bingo games to determine the predetermined game outcome provided to the player at that gaming device. In one embodiment, the bingo game is displayed to the player. In another embodiment, the bingo game is not displayed to the player, but the results of the bingo game determine the predetermined game outcome provided to the player.

In the various bingo embodiments, as each gaming device is enrolled in the bingo game, such as upon an appropriate wager or engaging an input device, the enrolled gaming device is provided a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing a different bingo card to each of a plurality of enrolled gaming devices, the central controller randomly selects or draws, one at a time, a plurality of the elements. As each element is selected, each gaming device determines if the selected element is present on the bingo card provided to that enrolled gaming device. If the selected element is present on the bingo card provided to that enrolled gaming device, that gaming device marks or flags the selected element on the provided bingo card. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome each gaming device determines for the bingo game is utilized by that gaming device to determine the predetermined game outcome provided to the player. For example, a first gaming device to mark selected elements in a predetermined pattern is provided a first outcome of win $10 which will be provided to a first player regardless of how the first player plays in a first game and a second gaming device to mark selected elements in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above. It should be further appreciated that other suitable methods for selecting or determining one or more predetermined game outcomes may be employed.

In another embodiment, the central server also monitors the activity of one, more or each of the gaming devices in communication with the central server or controller. In this embodiment, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In another embodiment, a plurality of gaming devices at one, more or each gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In operation, upon a suitable triggering event, the central server or controller determines and selects one of a plurality of executable game programs from the stored set or pool of game programs. In different embodiments, the selected game program is predetermined, randomly determined, determined based on the player's wager, determined based on a player's selection, determined based on the player's status (such as determined through a player tracking system), determined based on a level of a jackpot award, determined based on time (such as the time of day or how long the current game program has been playing) or determined based on any other suitable method.

In one embodiment, the selected game program is communicated to one, more or each gaming devices in the gaming system. Each different game program is executable by a gaming device to provide a different setting, configuration or type of game to the player of that gaming device. In different embodiments, one setting or type of game program may utilize a different paytable than the paytable utilized by another setting or type of game program. For example, a specific combination of three symbols may be associated with a payout of ten for a first setting or game program communicated from the central controller, while the same specific combination of the same three symbols may be associated with a payout of forty for a second setting or game program communicated from the central controller.

In another embodiment, different types of game programs will assign different functions to the same symbols. For example, for one setting or game program communicated from the central controller, a designated symbol, such as a cherry symbol, may function as a wild symbol, while for another setting or game program communicated from the central controller, the same designated symbol may have a different function or no function.

In one embodiment, a selected game program will not utilize or spin the outer members of the concentric symbol generator sets. In this embodiment, when the selected game program is executed and the concentric reel sets are activated, only the inner members will spin and the outer members will remain stationary in a position which displays one or more windows. In another embodiment, a selected game program will utilize or spin the outer members of one, more or each concentric reel sets. In this embodiment, when the selected game program is executed, the outer members may or may not spin to generate a symbol or a viewing area on an active payline. In different embodiments, the determination of whether the outer member spins is predetermined, randomly determined, determined based on the player's wager, determined based on the player's status (such as determined through a player tracking system), determined based on a player's selection, determined based on a level of a jackpot award, determined based on time (such as the time of day or how long the current game program has been playing) or determined based on any other suitable method.

In another embodiments, different game programs may each be associated with utilizing or spinning different outer members. For example, one game program may be associated with the activation of one outer member, another game program may be associated with the activation of another outer member and another game program may be associated with the activation of a plurality of outer members.

In another embodiment, different game programs are utilized to alter, substitute or interchange the symbols which may be generated by the concentric reels. In this embodiment, a selected game program will utilize the subset of symbols associated with that game program, wherein the subset of symbols is part of the fixed set of symbols associated with the physical symbol generators. That is, if a selected game program is associated with a subset of symbols, only the symbols included in the subset of symbols may be generated by the gaming device during the execution of the selected game program. It should be appreciated that any suitable combination of symbols from the fixed set of symbols may be utilized as an appropriate subset of symbols.

Figure 5:
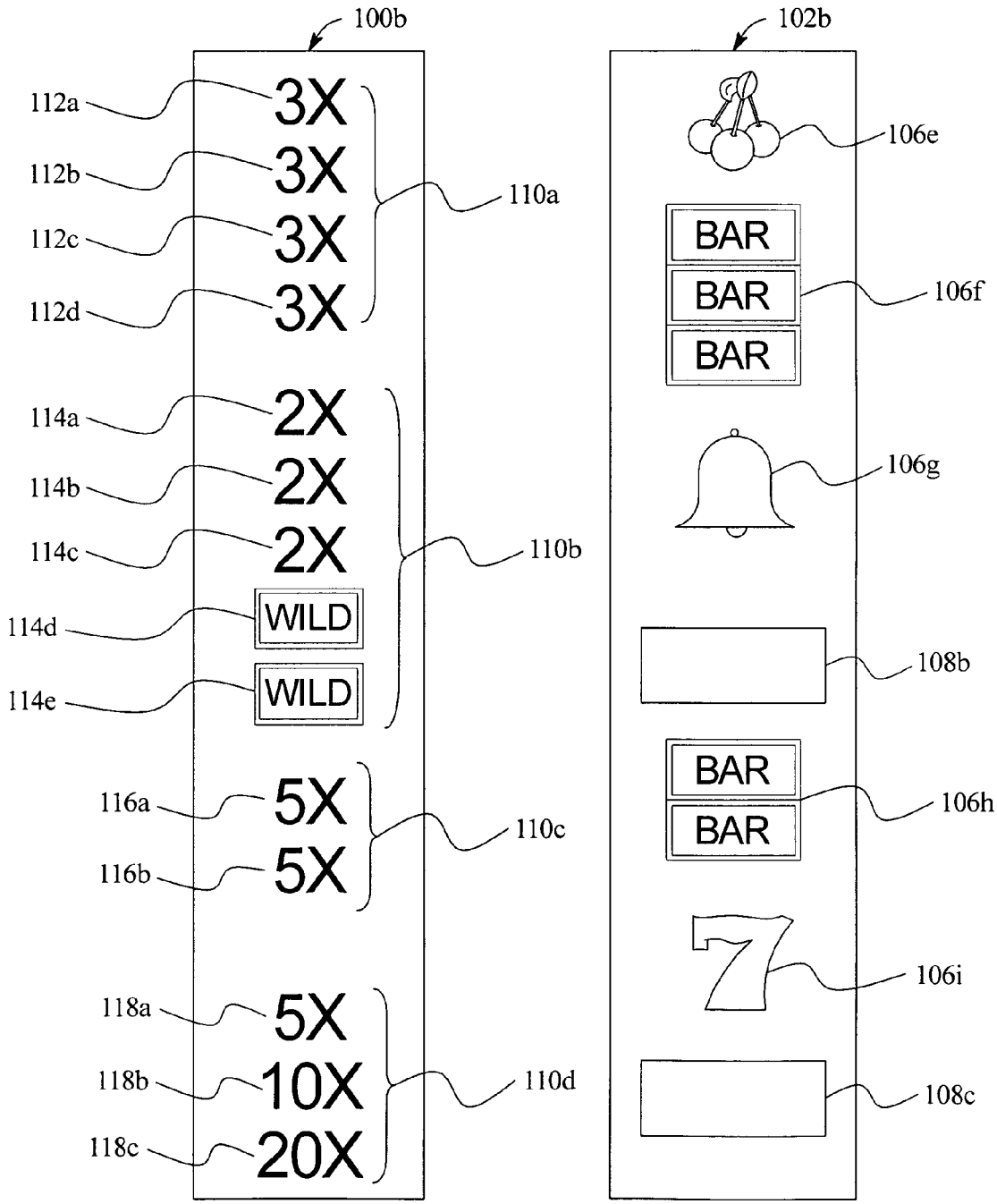
FIG. 5 is a front elevation view of one concentric reel strip, wherein the inner reel includes a plurality of symbol sets and the outer reel includes at least one window.

As illustrated in FIG. 5, the inner member or inner reel 100*b* of one, more or each concentric reel sets includes a plurality of symbols 112, 114, 116 and 118, wherein the plurality of symbols are grouped into a plurality of different symbol subsets 110. In this embodiment, each symbol subset is associated with one or more of the settings, configurations or game programs which may be communicated to the gaming device from the central server. That is, the symbol subset which the gaming device processor will utilize for any particular game play is dependent on which executable game program is communicated to the gaming device. In this embodiment, only the symbols included in the symbol subset associated with the selected game program may be generated on the inner reel in a position viewable through a window of the outer reel. For example, if a first game program (i.e. a first game or type of game) is communicated to the gaming device and the first game program is associated with a first subset of symbols of the inner reel, then only the symbols from the first subset of symbols will be available to be generated on the inner reel during the execution or play of the first game program. On the other hand, if a second game program (i.e., a second game or type of game) is communicated to the gaming device and the second game is associated with a second different subset of symbols of the inner reel, then only the symbols from the second different subset of symbols will be available to be generated on the inner reel during the execution of the second game program.

As seen in FIG. 5, a first symbol subset 110*a* of the inner reel includes four 3× multiplier symbols 112*a* to 112*d*. This symbol subset is associated with the execution of a first setting, configuration or game program communicated from the central controller. A second symbol subset 110*b* of the inner reel includes three 2× multiplier symbols 114*a* to 114*c* and two wild symbols 114*d* and 114*e*. This symbol subset is associated with the execution of a second setting, configuration or game program communicated from the central controller. A third symbol subset 110*c* of the inner reel includes two 5× multiplier symbols 116*a* and 116*b*. This symbol subset is associated with the execution of a third setting, configuration or game program communicated from the central controller. A fourth symbol subset 110*d* of the inner reel includes a 5× multiplier symbol 118*a*, a 10× multiplier symbol 118*b* and a 20× multiplier symbol 118*c*. This symbol subset is associated with the execution of a fourth setting, configuration or game program communicated from the central controller.

In one embodiment, each inner reel symbol subset includes the same number of symbols. In another embodiment, a plurality of inner reel symbol subsets each include a different number of symbols. In another embodiment, each inner reel symbol subset includes a different number of symbols. In one embodiment, the number of symbols in each symbol subset is determined based on the symbols in that subset. For example, as seen in FIG. 5, symbol subset 110*a* includes four 3× symbols while symbol subset 110*c* includes two 5× symbols. It should be appreciated that any of the inner reel symbol subsets may include one or more blank symbols.

As seen in FIG. 5, in this example, the outer reel 102*b* includes a plurality of symbols, such as a cherry symbol 106*e*, a triple bar symbol 106*f*, a bell symbol 106*g*, a double bar symbol 106*h* and a seven symbol 106*i*. The outer reel also includes one or more viewable areas or windows 108*b* and 108*c* which each can display one or more of the symbols on the inner reel.

Figure 6A:
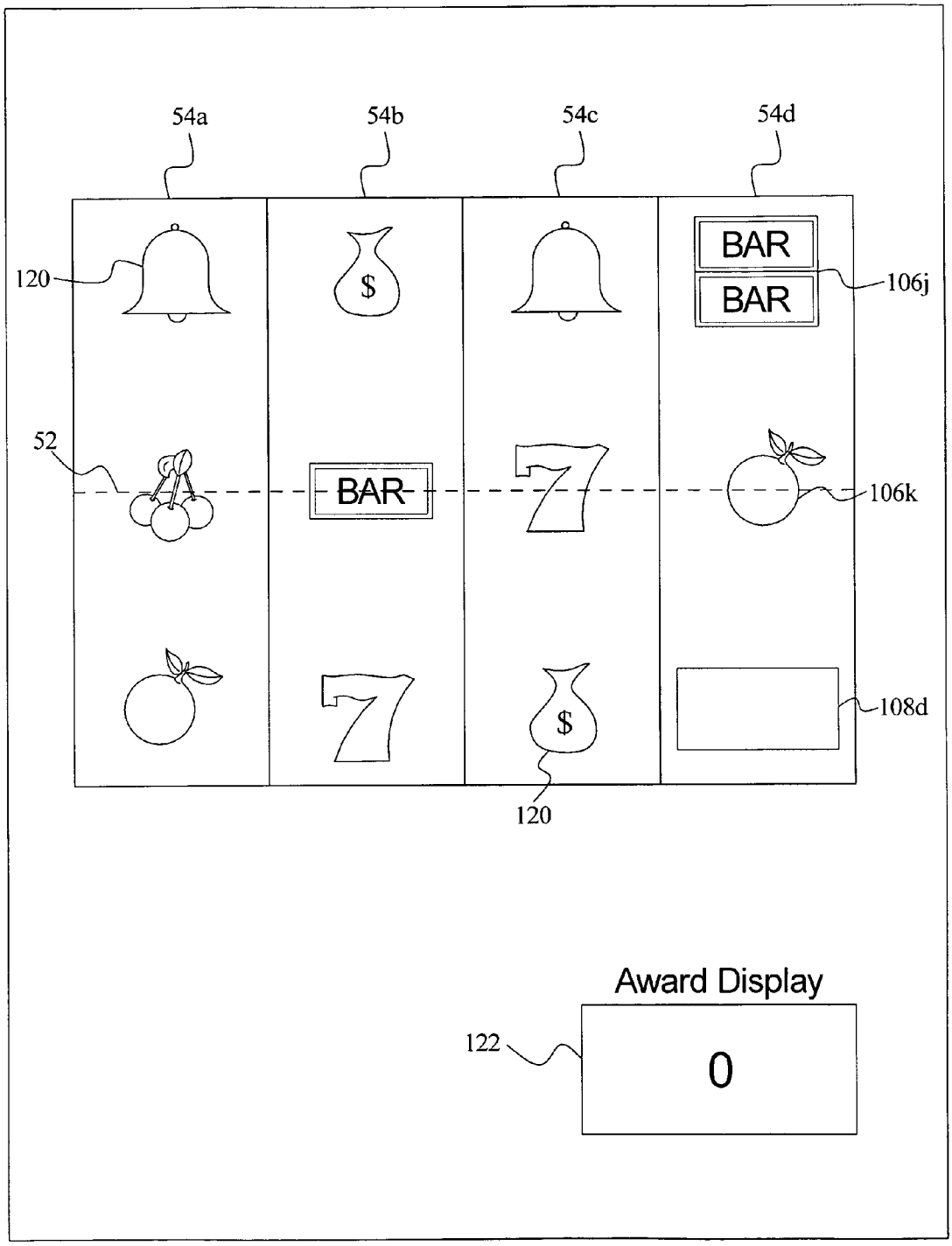
FIGS. 6A, 6B and 6C are enlarged elevation views of an example of a play of a game displayed by a gaming device employing the concentric reel strip illustrated in FIG. 5.

An example of the operation of a gaming device according to the above embodiment is illustrated in FIG. 6A wherein the gaming device includes four reel sets 54*a*, 54*b*, 54*c* and 54*d*. In this example, reel sets 54*a*, 54*b* and 54*c* are traditional reel sets (i.e., non-concentric reel sets) and reel set 54*d* is a concentric reel set as described above. Therefore, reel set 54*d* includes an inner reel and an outer reel.

Upon a suitable triggering event, such as a player placing a wager, at a designated time of day, a selection by a player, a selection by a casino operator or an automatic selection, an appropriate game program is selected and communicated to the gaming device. In this example, the second setting, configuration or type of game has previously been selected and communicated from the central controller. Accordingly, as described above, during the play of the game, only the symbols from the second symbol subset (which is associated with the second setting or configuration) may be generated on the inner reel.

Figure 6B:
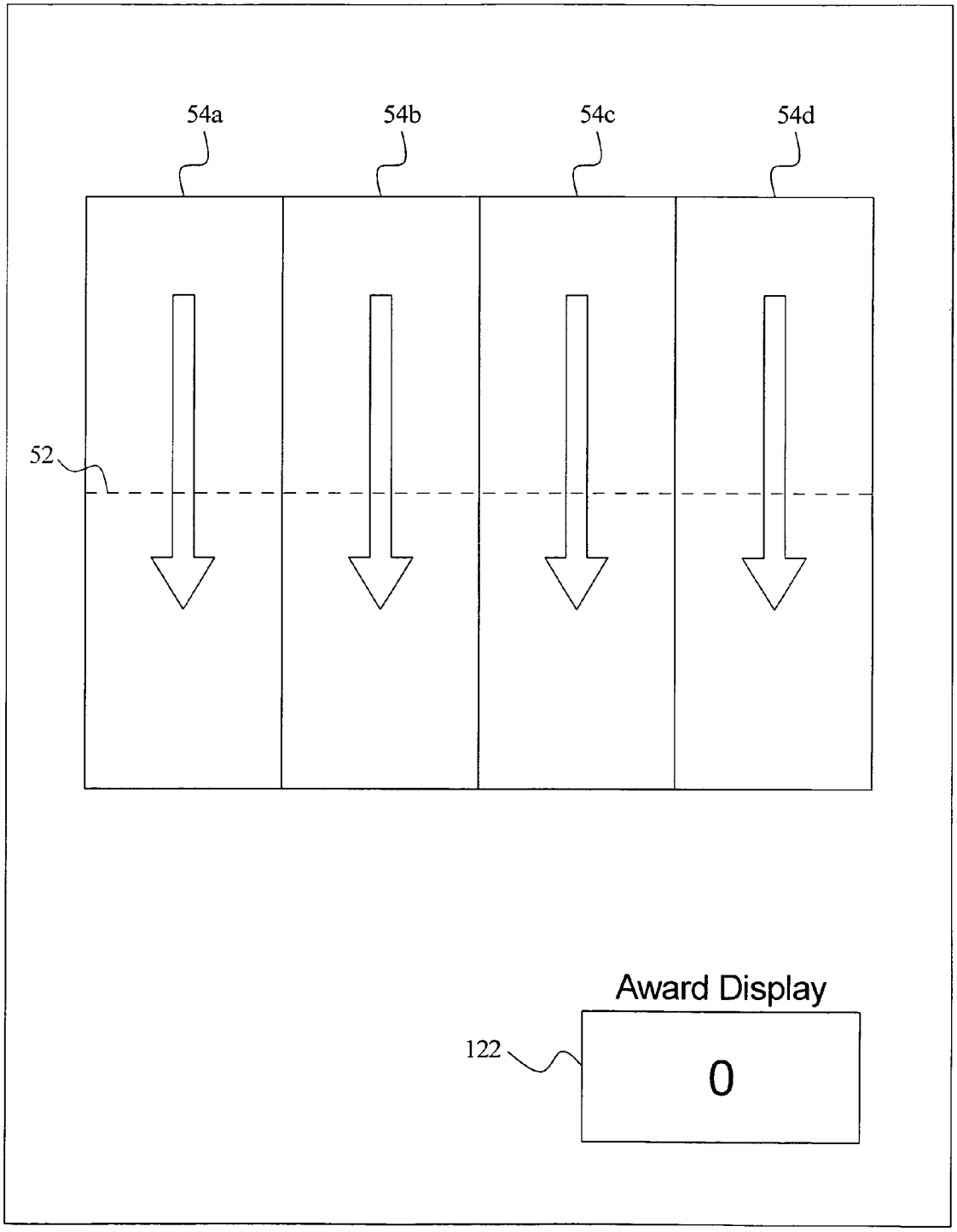

As seen in FIG. 6B, after receiving the selected game program, the gaming device processor executes the selected game program. In this example, following the selected game program, the gaming device processor activates or spins each of the plurality of symbol generators.

Figure 6C:
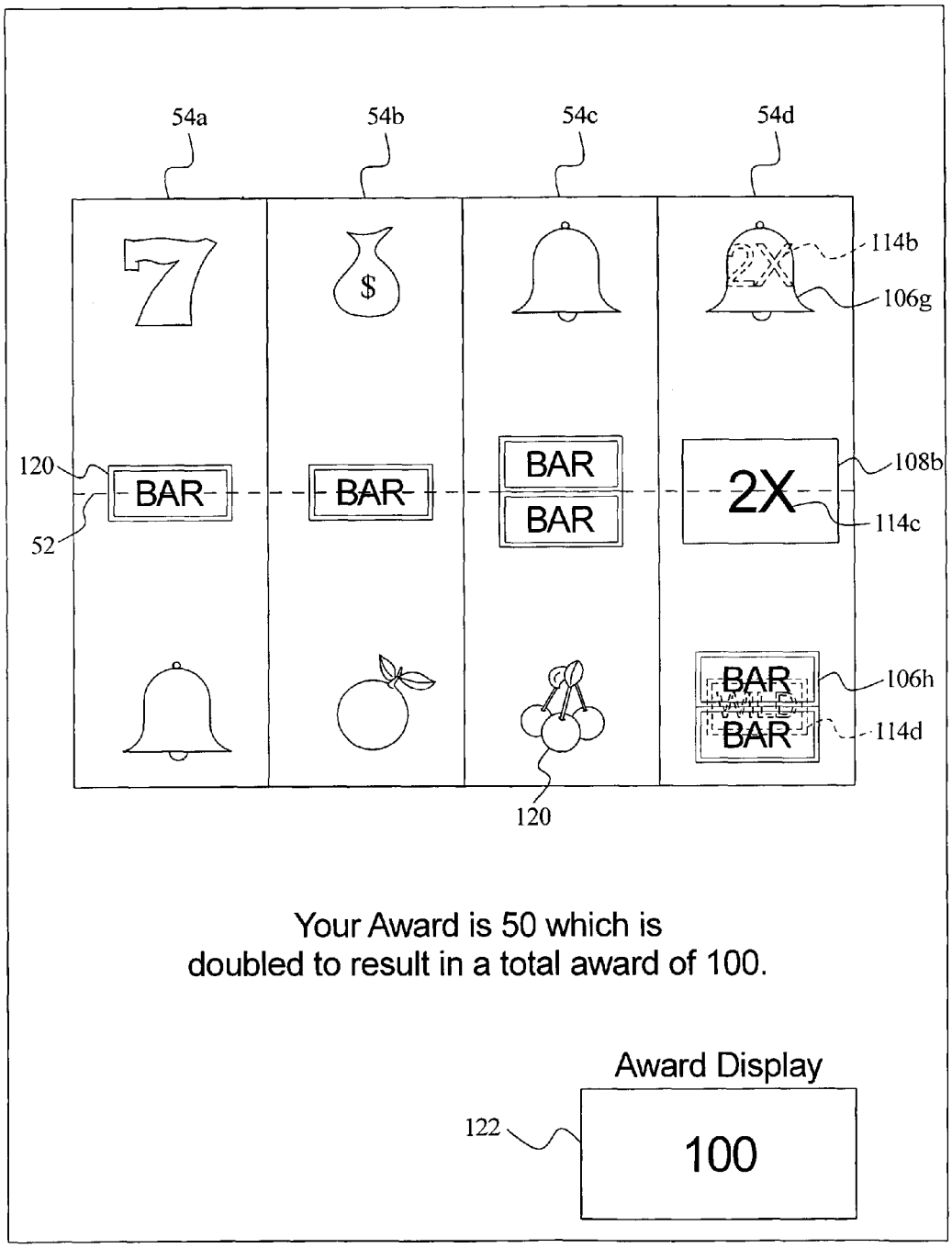

As illustrated in FIG. 6C, when the reel sets stop spinning, each of the conventional reels indicate one or more symbols 120. Additionally, the outer reel of the concentric reel set indicates a plurality of viewable areas or windows and a plurality of symbols 106. For example, reel set 54*d* displays or indicates window 108*b* and a bell symbol 106*g* and a double bar symbol 106*h*. Moreover, the indicated viewable area or window displayed by the outer reels of reel sets 54*d* displays or indicates one or more symbols on the inner reel of the concentric reel set. For example, a 2× multiplier symbol 114*c* is displayed by the viewable area 108*b* of reel set 54*d*. As illustrated in FIG. 6C, the 2× multiplier symbol 114*b* and the wild symbol 114*d* are shown in phantom because such symbols are not viewable through window 108*b*.

After generating a plurality of symbols, the gaming device evaluates the symbols generated on any of the active paylines to determine if a generated symbol or symbol combination is associated with a payout. In this example, as illustrated in FIG. 6C, the symbol combination of single bar, single bar and double bar are generated on payline 52. Accordingly, the gaming device determines that an award or payout of fifty is associated with this symbol combination. Moreover, since the 2× multiplier symbol 114*c* is also generated on payline 52, the gaming device modifies the determined payout of fifty by the 2× multiplier to result in a total payout of one-hundred. The total payout is displayed in the award display 122 and provided to the player. Appropriate messages such as "YOUR AWARD IS 50 WHICH IS DOUBLED TO RESULT IN A TOTAL AWARD OF 100" may be provided to the player visually, or through suitable audio or audiovisual displays. It should be appreciated that the gaming device may provide an outcome to a player based on designated symbol combinations occurring on the paylines associated with the reel sets, symbol combinations occurring on a plurality of paylines (i.e., scatter pays) or for any suitable symbol combinations indicated by the reel sets in a play of the game.

Figure 7A:
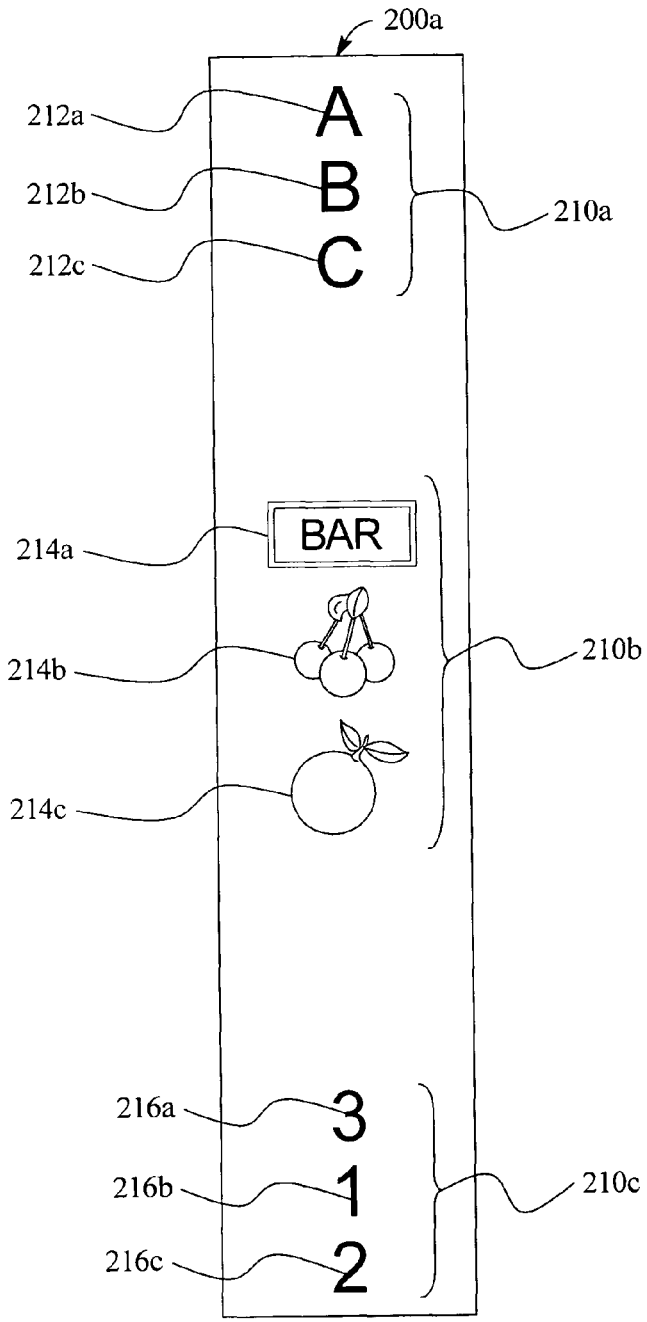
FIGS. 7A and 7B are front elevation views of two different inner reels which each include a plurality of symbol sets.
Figure 7B:
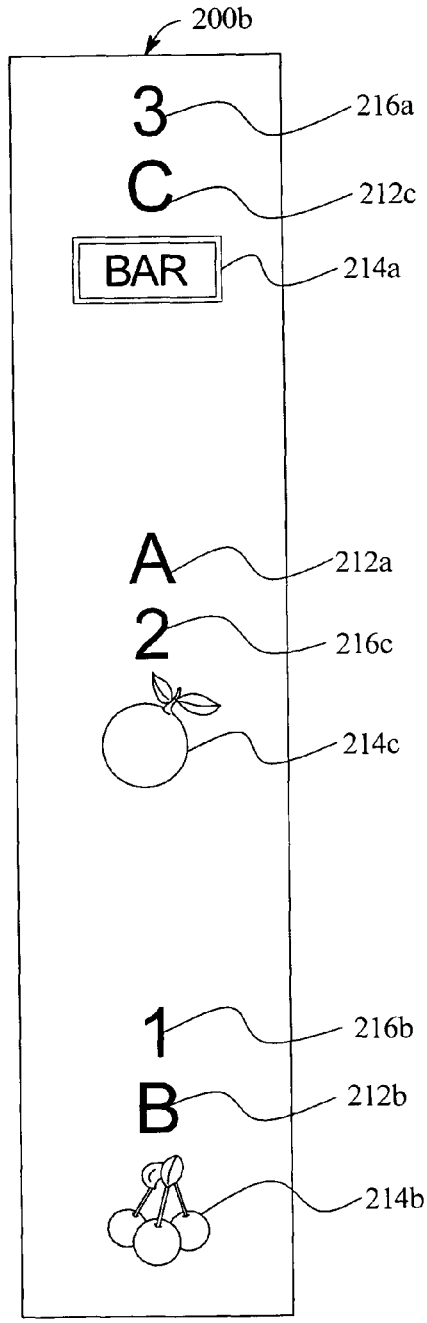

FIGS. 7A and 7B illustrate another embodiment wherein an inner reel includes a plurality of symbols grouped into different symbol subsets. As seen in FIG. 7A, a first symbol subset 210*a* of the inner reel includes an "A" symbol 212*a*, a "B" symbol 212*b* and a "C" symbol 212*c*. This symbol subset is associated with the execution of a first setting, configuration or game program communicated from the central controller. A second symbol subset 210*b* of the inner reel includes a bar symbol 214*a*, a cherry symbol 214*b* and an orange symbol 214*c*. This symbol subset is associated with the execution of a second setting, configuration or game program communicated from the central controller. A third symbol subset 210*c* of the inner reel includes a "3" symbol 216*a*, a "1" symbol 216*b* and a "2" symbol 216*c*. This symbol subset is associated with the execution of a third setting, configuration or game program communicated from the central controller. As illustrated in FIGS. 7A and 7B, these symbols may be arranged by group (FIG. 7A) on the inner reel or randomly arranged on the inner reel (FIG. 7B).

Figure 8:
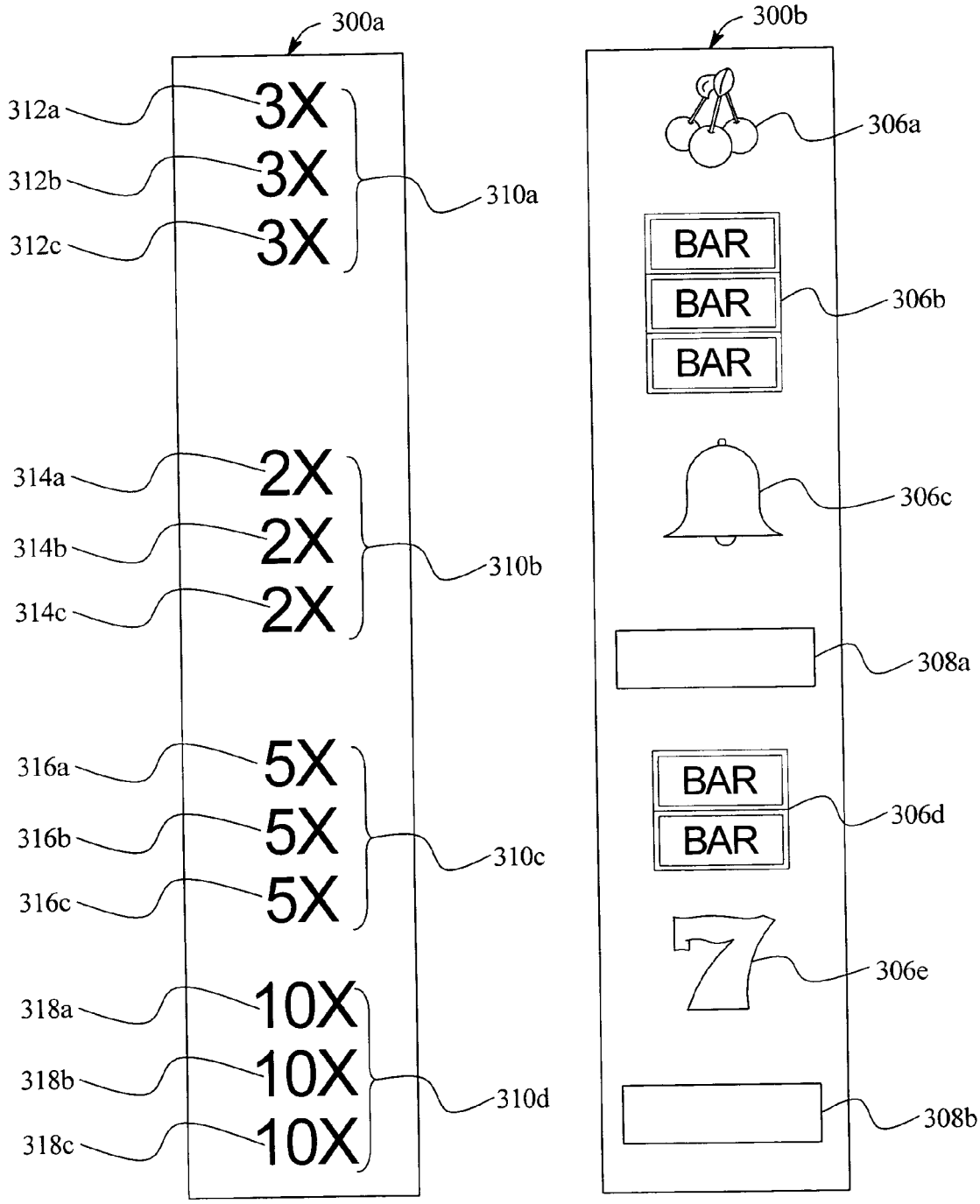
FIG. 8 is a front elevation view of one concentric reel strip, wherein the inner reel includes a plurality of symbol sets and the outer reel includes at least one window.

In another embodiment, upon a suitable triggering event, an appropriate game program is selected and communicated to the gaming device. In this embodiment, one or more inner reels are rotated such that the symbols in the symbol subset associated with the selected game program are displayed to the player through the viewable window (or would be displayed if the viewable window were in the appropriate position) and the inner reel is locked. Such locking of the inner reel provides that during the play of the game, only the symbols from the symbol subset is associated with the communicated game program may be displayed on the inner reel. For example, utilizing the reel set illustrated in FIG. 8, if the second game program is selected, then the inner reel of a first reel set is rotated and locked or held in a position such that three 2× multiplier symbols 314*a* to 314*c* of the second symbol subset 310*b* are displayed to the player through the viewable window of the outer reel (or would be displayed if the viewable window of the outer reel were in the appropriate position). It should be appreciated that the locking of a reel may include not spinning the reel or spinning the reel wherein the spun reel is stopped at a designated position.

After locking the inner reel into an appropriate position, the gaming device processor executes the selected game program. In this example, since the first inner reel is locked into a position which displays the symbols from the second subset of symbols, when the gaming device processor activates or spins one or more of the symbol generations, such locked inner reel is not activated to spin. When the reel sets stop spinning, the gaming device evaluates the symbols generated on any of the active paylines to determine if a generated symbol or symbol combination is associated with a payout. In the described example, since the first inner reel is locked, if any windows are indicated by the outer reel of the first reel set, then only the 2× multiplier symbol 314*a* to 314*c* will be viewable through such indicated windows. It should be appreciated that since only the locked symbols of the first inner reel will be viewed if a window of the outer reel is indicated, locking the inner reel effectively functions to change one or more symbols of the outer reel. For example, if symbols 312*a* to 312*c* of the first symbol set 310*a* are locked, the gaming device is effectively adding a 3× multiplier symbol to the outer reel for the executed game program. On the other hand, if symbols 318*a* to 318*c* of the fourth symbol set 310*d* are locked, the gaming device is effectively adding a 10× multiplier symbol to the outer reel for the executed game program.

Figure 9:
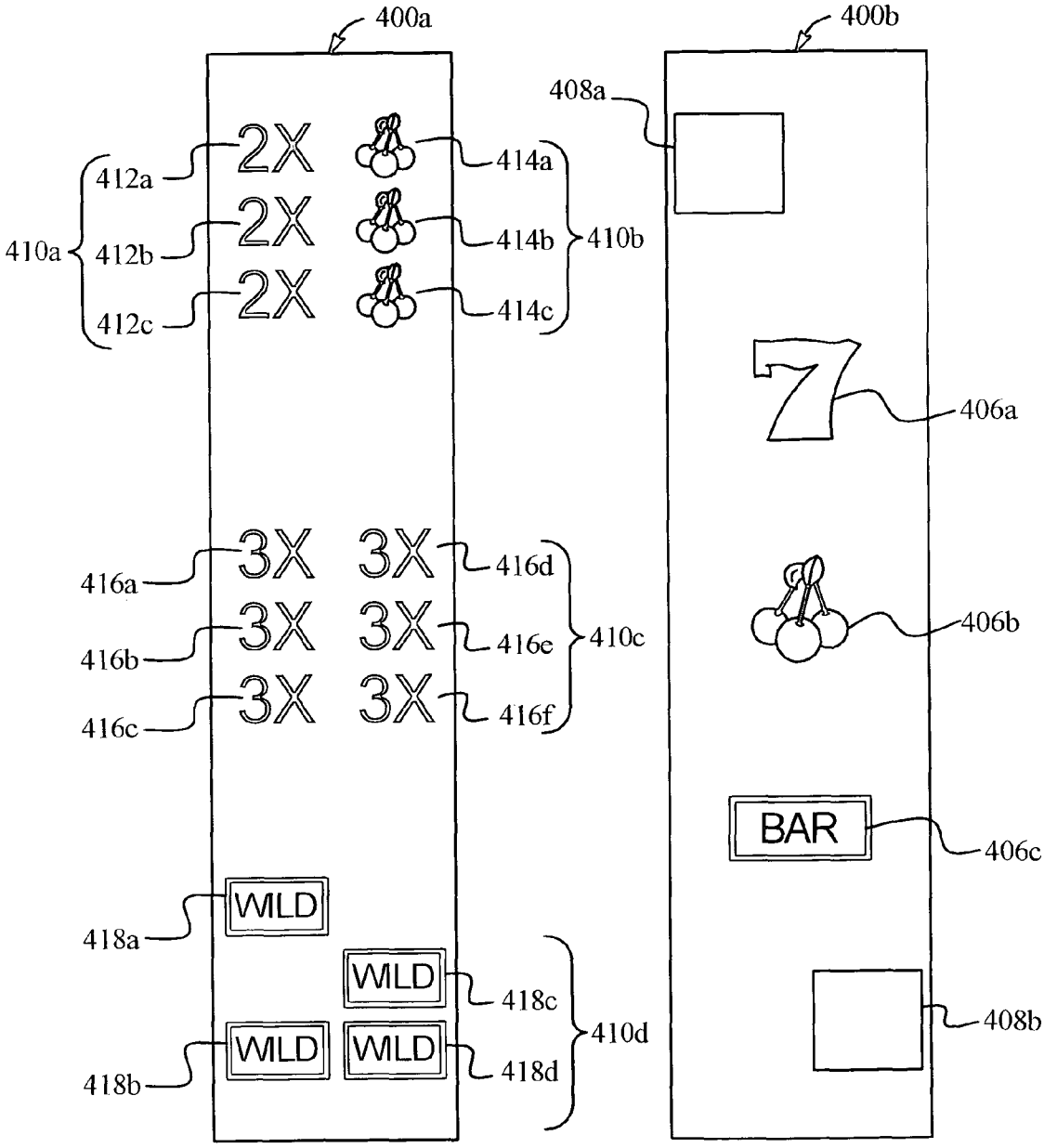

In another embodiment, one or more reel sets may each include one or more symbols which are generated and displayed side-by-side on the same reel through an appropriately sized window on the outer reel. As illustrated in FIG. 9, the inner reel includes a plurality of symbols positioned on either side of the inner reel. The outer reel includes a plurality of viewable areas or windows which are positioned on different sides of the outer reel. In one embodiment, side-by-side symbols may be from different symbol subsets. For example, as illustrated in FIG. 9, 2× multiplier symbols 412*a* to 412*c* are from one symbol set 410*a* while cherry symbols 414*a* to 412*c* (which are positioned side-by-side with the 2× multiplier symbols) are from another symbol set 410*b*. In this example, if the executed game program requires the generation of a 2× symbol, the gaming device stops the outer reel in a position such that left-side window 408*a* is generated and if the executed game program requires the generation of a cherry symbol, the gaming device stops the outer reel in a position such that right-side window 408*b* is generated. Accordingly, in this embodiment, the gaming devices utilize the different side-by-side symbol positions of the inner reel and the different window positions of the outer reel to implement the use of different symbols which may be specific to the play of one or more different executable game programs.

In another embodiment, side-by-side symbols may be from the same symbol subset. For example, 3× multiplier symbols 416*a* to 416*f* are from one symbol set 410*c*. In this example, since the 3× multiplier symbol is positioned on either side of the reel, regardless of which side of the reel the window is generated, the 3× multiplier will be viewed through the displayed outer reel window. In one example, for one symbol subset, the left symbol position and the right symbol position may each include the same symbol and be part of the same subset of symbols. In another example, a left symbol position may include one type of symbol associated with a first symbol subset and a right symbol position may include another type of symbol associated with a second symbol subset. In another embodiment, if two or more symbols are displayed side-by-side on the same reel, for award determination purposes, the gaming device treats each of the side-by-side symbols as if they were on separate reels.

In one alternative embodiment, a plurality of game programs are selected. In this embodiment, the plurality of game programs are executed sequentially or simultaneously. In an alternative embodiment, the selected game program is communicated to a local processor separate from the gaming device. In this embodiment, the local processor receives the selected game program and executes and displays the selected game program on one, more or each of the gaming devices in the gaming system.

In another embodiment, the plurality of game programs are stored locally in the memory device of each individual gaming device. In this embodiment, upon a suitable triggering event, one of a plurality of game programs are selected from the memory device of the gaming device. The selected game program is executed by the processor of the gaming device and the game associated with the selected game program is provided to the player.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device operable under control of a processor, said gaming device comprising:

a plurality of reel sets, wherein at least a first one of the reel sets includes an inner reel and an outer reel concentrically arranged around the inner reel, the outer reel of the first reel set defines at least one viewable area through which the inner reel is viewable;

at least one input device;

at least one display device; and at least one memory device which stores a plurality of instructions, which when executed by the processor, cause the processor to operate with the plurality of reel sets, the at least one display device and the at least one input device to:

(a) provide at least one play of a first game when the first game is selected to be played after a first wager amount is placed, said first game having a first set of symbols including: (i) a plurality of symbols on the outer reel of the first reel set, and (ii) at least one first game symbol on the inner reel of the first reel set, and the at least one play of the first game includes generating at least one of the symbols of the first set of symbols, said generation includes causing the inner reel and outer reel to be positioned such that the generated first game symbols on the inner reel are viewable through the viewable area of the outer reel, said selection to play the first game being independent of any generation of any symbols associated with any play of any second game; and (b) provide at least one play of a second game when the second game is selected to be played after said first wager amount is placed, said second game being different than the first game, said second game having a second set of symbols including: (i) the plurality of symbols on the outer reel of the first reel set, and (ii) at least one second game symbol on the inner reel of the first reel set, said second game symbols being different than said first game symbols, and the at least one play of the second game includes generating at least one of the symbols of the second set of symbols, said generation includes causing the inner reel and outer reel to be positioned such that the generated second game symbols on the inner reel are viewable through the viewable area of the outer reel, said selection to play the second game being independent of any generation of any symbols associated with any play of the first game.

2. The gaming device of claim 1, wherein the first set of symbols includes a plurality of first game symbols.

3. The gaming device of claim 2, wherein the play of the first game includes generating a plurality of the symbols of the first set of symbols.

4. The gaming device of claim 1, wherein the second set of symbols includes a plurality of second game symbols.

5. The gaming device of claim 4, wherein the play of the second game includes generating a plurality of the symbols of the second set of symbols.

6. The gaming device of claim 1, wherein each game is associated with a different paytable which is used if said game is selected.

7. The gaming device of claim 1, wherein the first and second games are processor selectable.

8. The gaming device of claim 1, wherein the first and second games are selectable by a second processor remote from the gaming device.

9. A gaming device operable under control of a processor, said gaming device comprising:

a plurality of reel sets, wherein each of the reel sets includes an inner reel and an outer reel concentrically arranged around the inner reel, the outer reel of the each reel set defines at least one viewable area through which the inner reel of said set is viewable;

at least one input device;

at least one display device; and at least one memory device which stores a plurality of instructions, which when executed by the processor, cause the processor to operate with the plurality of reel sets, the at least one display device and the at least one input device to:

(a) provide at least one play of a first game when the first game is selected to be played after a first wager amount is placed, said first game having a first set of symbols including: (i) a plurality of symbols on the outer reels of the reel sets, and (ii) a plurality of first game symbols on the inner reels of the reel sets, and the at least one play of the first game includes generating at least one of the symbols of the first set of symbols, said generation includes causing the inner reel and outer reel of said reel set to be positioned such that the generated first game symbols on said inner reel of said reel set are viewable through the viewable area of the outer reel of said reel set, said selection to play the first game being independent of any generation of any symbols associated with any play of any second game; and (b) provide at least one play of a second game when the second game is selected to be played after said first wager amount is placed, said second game being different than the first game and having a second set of symbols including: (i) the plurality of symbols on the outer reels of the reel sets, and (ii) a plurality of second game symbols on the inner reels of the reel sets, said second game symbols being different than said first game symbols, and the at least one play of the second game includes generating at least one of the symbols of the second set of symbols, said generation includes causing the inner reel and outer reel of at least one of said reel sets to be positioned such that the generated second game symbols on the inner reel of said reel set are viewable through the viewable area of the outer reel of said reel set, said selection to play the second game being independent of any generation of any symbols associated with any play of the first game.

10. The gaming device of claim 9, wherein each game is associated with a different paytable which is used if that game is selected.

11. The gaming device of claim 9, wherein the play of the first game includes generating a plurality of the symbols of the first set of symbols.

12. The gaming device of claim 9, wherein the play of the second game includes generating a plurality of the symbols of the second set of symbols.

13. The gaming device of claim 9, wherein the first set of symbols includes a plurality of first game symbols on one of the inner reels of one of the reel sets.

14. The gaming device of claim 9, wherein the second set of symbols includes a plurality of second game symbols on one of the inner reels of one of the reel sets.

15. The gaming device of claim 9, wherein the first and second games are processor selectable.

16. The gaming device of claim 9, wherein the first and second games are selectable by a second processor remote from the gaming device.

17. A gaming device operable under control of a processor, said gaming device comprising:

a plurality of reel sets configured to operate with the processor, wherein at least one of the reel sets is a concentric reel set that includes:

an inner reel including a plurality of symbols; and an outer reel including a plurality of symbols, wherein the outer reel defines at least one viewable area which is positionable such that at least one of the symbols on the inner reel is viewable through the viewable area; and at least one memory device configured to operate with the processor, said at least one memory device stores:

(a) a first game program associated with a first wager amount, wherein the first game program is associated with each of the symbols of the outer reel and any selection to play the first game program being independent of any generation of any symbols associated with any play of any second game program; and (b) a second game program associated with the first wager amount, any selection to play the second game program being independent of any generation of any symbols associated with any play of the first game program, wherein the stored game program is associated with a plurality of symbols of the outer reel and at least one of the symbols of the inner reel, wherein if one of the symbols of the inner reel is generated during a play of the second game program, the outer reel of at least one of the concentric reel sets moves to indicate one of said viewable areas and the inner reel of said concentric reel set is positioned such that the at least one symbol of the inner reel is viewable through the indicated viewable area.

18. The gaming device of claim 17, wherein the first stored game program is also associated with at least one of the symbols of the inner reel.

19. The gaming device of claim 18, wherein at least one of the symbols of the inner reel associated with the first stored game program is different than at least one of the symbols of the inner reel associated with the second stored game program.

20. The gaming device of claim 17, wherein the outer reel defines at least one viewable area which is positionable such that a plurality of the symbols on the inner reel are viewable through the viewable area.

21. The gaming device of claim 17, wherein the first and second game programs are processor selectable.

22. The gaming device of claim 17, wherein the first and second game programs are selectable by a second processor remote from the gaming device.

23. A gaming device operable under control of a processor, said gaming device comprising:

a plurality of reel sets, wherein at least one of the reel sets is a concentric reel set that includes:

an inner reel including a first symbol set and a second selectable symbol set, the first symbol set associated with a first game and including a plurality of first symbols and the second symbol set associated with a second game and including at least one second symbol which is different than the symbols of the first symbol set; and an outer reel including a plurality of third symbols, wherein the outer reel defines at least one viewable area which is positionable such that at least one of the symbols on the inner reel is viewable through the viewable area;

at least one input device;

at least one display device; and at least one memory device which stores a plurality of instructions, which when executed by the processor, cause the processor to operate with the plurality of reel sets, the at least one display device and the at least one input device to:

(a) when the first game is selected after a first wager amount is placed, in at least one play of the first game, move the outer reel of at least one of the concentric reel sets to indicate one of said viewable areas and the inner reel of said concentric reel set is positioned such that one of the symbols of the first symbol set is viewable through the indicated viewable area and said selection to play the first game being independent of any generation of any symbols associated with any play of the second game; and (b) when the second game is selected after said first wager amount is placed, in at least one play of the second game, move the outer reel of at least one of the concentric reel sets to indicate one of said viewable areas and the inner reel of said concentric reel set is positioned such that one of the symbols of the second symbol set is viewable through the indicated viewable area, said selection to play the second game being independent of any generation of any symbols associated with any play of the first game.

24. The gaming device of claim 23, wherein the second symbol set includes a plurality of second symbols.

25. The gaming device of claim 23, wherein at least one symbol of the plurality of first symbols is different than at least one symbol of the plurality of third symbols.

26. The gaming device of claim 23, wherein at least one symbol of the plurality of first symbols is the same as at least one symbol of the plurality of third symbols.

27. The gaming device of claim 23, wherein the at least one second symbol is different than at least one symbol of the plurality of third symbols.

28. The gaming device of claim 23, wherein the at least one second symbol is the same as at least one symbol of the plurality of third symbols.

29. The gaming device of claim 23, wherein the first and second games are processor selectable.

30. The gaming device of claim 23, wherein the first and second games are selectable by a second processor remote from the gaming device.

31. A gaming system comprising:

a controller;

a memory device configured to operate with the controller, wherein said memory device stores a plurality of different game programs, each game program is associated with at least one of a plurality of subsets of symbols, wherein said symbols of said plurality of subsets of symbols form a static set of symbols and at least two of the different game programs include different subsets of symbols; and a plurality of gaming devices in communication with the controller, each gaming device including a processor and a plurality of reel sets configured to operate with the processor, the plurality of reels sets including a plurality of symbols which form said static set of symbols, wherein at least one of the reel sets is a concentric reel set that includes:

an inner reel including a plurality of symbols; and an outer reel which defines at least one viewable area, wherein the outer reel is positionable such that at least one of the symbols on the inner reel is viewable through the viewable area;

wherein for each gaming device, the controller is programmed to select one of the different game programs and communicate the selected game program to said gaming device, said selection of one of the different game programs being independent of any generation of any of said symbols;

wherein each gaming device which the selected game program is communicated to is programmed, for at least one play of the selected game program, to:

(a) cause each of the reel sets to generate at least one symbol from the subset of symbols associated with the selected game program, wherein for each concentric reel set, the inner reel displays at least one of the symbols from the subset of symbols associated with the selected game program and the outer reel moves to indicate one of said viewable areas;

(b) determine any payout associated with the generated symbols; and (c) provide any determined payout to a player.

32. The gaming system of claim 31, wherein the inner reel and outer reel are each electromechanical.

33. The gaming system of claim 31, wherein the selected game program is from a group consisting of a predetermined game program, a randomly determined game program, a game program based on the player's status in a player tracking system, a game program based on the player's wager, a game program based on a selection by the player a game program based on time, and a game program based on a level of a jackpot award.

34. The gaming system of claim 31, wherein each game program is associated with a paytable which is used if that game program is selected.

35. The gaming system of claim 31, wherein at least one symbol is associated with different functions for different game programs.

36. The gaming system of claim 31, wherein the outer reel includes at least one symbol.

37. The gaming system of claim 31, wherein the outer reel includes a plurality of symbols.

38. The gaming system of claim 31, wherein the inner reel of the gaming device which the selected game program displays at least one of the symbols from the subset of symbols associated with the selected game program by moving the inner reel into a designated position.

39. The gaming system of claim 31, wherein the inner reel of the gaming device which the selected game program displays at least one of the symbols from the subset of symbols associated with the selected game program by locking the inner reel in a designated position.

40. A gaming system comprising:

a controller;

a memory device configured to operate with the controller, wherein said memory device stores a plurality of different game programs, wherein a plurality of game programs are each associated with a different function of at least one physical reel set; and a plurality of gaming devices in communication with the controller, each gaming device including a processor and a plurality of physical reel sets configured to operate with the processor, wherein at least one of the reel sets is a concentric reel set that includes:

an inner reel including a plurality of symbols; and an outer reel which defines at least one viewable area, wherein the outer reel is positionable such that at least one of the symbols on the inner reel is viewable through the viewable area;

wherein for each gaming device, the controller is programmed to select one of the different game programs and communicate the selected game program to said gaming device, said selection of one of the different game programs being independent of any generation of any of said symbols;

wherein each gaming device which the selected game program is communicated to is programmed to execute the selected game program, for at least one play of the selected game program, by:

(a) causing at least one of the reel sets to generate one of the symbols, wherein which reel sets generate which symbols is based on the selected game program and for each concentric reel set which generates one of the symbols, the inner reel indicates one of the symbols and the outer reel indicates one of said viewable area;

(b) determine any payout associated with the generated symbols; and (c) provide any determined payout to a player.

41. The gaming system of claim 40, wherein the selected game program is from a group consisting of a predetermined game program, a randomly determined game program, a game program based on the player's status in a player tracking system, a game program based on the player's wager, a game program based on a selection by the player, a game program based on time and a game program based on a level of a jackpot award.

42. The gaming system of claim 40, wherein each game program is associated with a paytable which is used if that game program is selected.

43. The gaming system of claim 40, wherein at least one symbol is associated with different functions for different game programs.

44. The gaming system of claim 40, wherein at least one game program is associated with movement of at least one outer reel and at least one game program is associated with the non-movement of at least one outer reel.

45. A gaming device operable under control of a processor, said gaming device comprising:

a plurality of reel sets configured to operate with the processor, the plurality of reels sets including a plurality of symbols which form a static set of symbols, wherein at least one of the reel sets is a concentric reel set that includes:

an inner reel including a plurality of symbols; and an outer reel which defines at least one viewable area, wherein said outer reel is positionable such that at least one of the symbols on the inner reel is viewable through the viewable area; and a memory device for storing a plurality of different game programs, wherein each game program is associated with at least one of a plurality of different subsets of symbols, wherein said symbols of said plurality of subsets of symbols form said static set of symbols;

wherein the processor is configured to operate with said memory device and said reel sets to select one of said game programs independent of any generation of any of said symbols and for at least one play of the selected game program:

(a) cause each of the reel sets to generate at least one symbol from the subset of symbols associated with the selected game program, wherein for each concentric reel set, the inner reel displays at least one of the symbols from the subset of symbols associated with the selected game program and the outer reel moves to indicate one of said viewable areas;

(b) determine any payout associated with the generated symbols; and (c) provide any determined payout to a player.

46. The gaming device of claim 45, wherein the inner reel displays at least one of the symbols from the subset of symbols associated with the selected game program by moving the inner reel into a designated position.

47. The gaming device of claim 45, wherein the inner reel displays at least one of the symbols from the subset of symbols associated with the selected game program by locking the inner reel in a designated position.

48. The gaming device of claim 45, wherein the plurality of different game programs are each processor selectable.

49. The gaming device of claim 45, wherein the plurality of different game programs are each selectable by a second processor remote from the gaming device.

50. A gaming device operable under control of a processor, said gaming device comprising:

a plurality of reel sets configured to operate with the processor, wherein at least one of the reel sets is a concentric reel set that includes:

an inner reel including a plurality of symbols; and an outer reel including a plurality of symbols, wherein the outer reel defines at least one viewable area and is positionable such that at least one of the symbols on the inner reel is viewable through the viewable area; and a memory device for storing a plurality of different game programs;

wherein the processor is configured to operate with the memory device and the reel sets to select one of the different game programs independent of any generation of any of said symbols and for at least one play of the selected game program:

(a) cause at least one of the reel sets to generate one of the symbols, wherein which reel sets generate which symbols is based on the selected game program and for each concentric reel set which generates one of the symbols, the inner reel indicates one of the symbols and the outer reel indicates one of said viewable areas;

(b) determine any payout associated with the generated symbols; and (c) provide any determined payout to a player.

51. The gaming device of claim 50, wherein the plurality of different game programs are each processor selectable.

52. The gaming device of claim 50, wherein the plurality of different are each selectable by a second processor remote from the gaming device.

* * * * *

UNITED STATES PATENT AND TRADEMARK OFFICE

CERTIFICATE OF CORRECTION

PATENT NO. : 7,753,773 B2
APPLICATION NO. : 11/212354
DATED : July 13, 2010
INVENTOR(S) : Baerlocher et al.

It is certified that error appears in the above-identified patent and that said Letters Patent is hereby corrected as shown below:

IN THE CLAIMS:

In Claim 40, Column 27, Line 24, replace “area” with --areas--.

In Claim 52, Column 28, Line 59, replace “different are” with --different game programs are--.

Signed and Sealed this
First Day of February, 2011

David J. Kappos

David J. Kappos
*Director of the United States Patent and Trademark Office*